United States Patent [19]

Blickenstaff

[11] 4,094,948

[45] June 13, 1978

[54] IMPROVED ACRYLONITRILE POLYMER SPINNING PROCESS

[75] Inventor: Robert Alan Blickenstaff, Charlottesville, Va.

[73] Assignee: E. I. Du Pont de Nemours and Company, Wilmington, Del.

[21] Appl. No.: 692,936

[22] Filed: Jun. 4, 1976

Related U.S. Application Data

[60] Division of Ser. No. 294,184, Oct. 2, 1972, Pat. No. 3,984,601, which is a continuation-in-part of Ser. No. 189,202, Oct. 14, 1971, abandoned.

[51] Int. Cl.[2] ..... D01F 6/18

[52] U.S. Cl. ..... 264/206; 260/29.6 AN; 264/211

[58] Field of Search ..... 264/206, 211, 29.6 AW

[56] References Cited

U.S. PATENT DOCUMENTS

| | | | |
|---|---|---|---|
| 2,585,444 | 2/1952 | Coxe | 264/182 |
| 3,309,734 | 3/1967 | Bynum et al. | 264/206 |
| 3,770,856 | 11/1973 | Ueki et al. | 264/13 |
| 3,774,387 | 11/1973 | Woodell | 264/182 |
| 3,873,508 | 3/1975 | Turner | 260/88.7 R |
| 3,896,204 | 7/1975 | Goodman et al. | 264/208 |
| 3,991,153 | 11/1976 | Klausner et al. | 264/211 |

*Primary Examiner*—Jay H. Woo

[57] ABSTRACT

Substantially single-phase compositions which are substantially partial or complete hydrates of an acrylonitrile polymer containing at least 40% acrylonitrile units can be shaped into filaments and films. The nitrile groups of the polymer are hydrated to a selected extent depending on the particular polymer used. Hydration occurs only within a certain elevated temperature range and under at least autogenous pressure. Also disclosed are films and filaments having novel structural features which are spun from the substantially single-phase compositions comprising polymers or copolymers of 80% or more acrylonitrile. The filaments are characterized by a sheath which has a density gradient in which the density increases toward the surface and, after drawing, by a unique luster source ratio related to reflective interfaces. Many of the filaments have surface striations and an optically microvoided core. The filaments contribute good hand and good water absorption properties to fabrics made therefrom.

2 Claims, 3 Drawing Figures

FRACTION NITRILES-O OR FRACTION HYDRATED NITRILES-X
1.0
.9
.8
.7
.6
.5
.4
.3
.2
.1
0
100
120
140
160
180
200
220
240
TEMP °C

FRACTION HYDRATED NITRILES
1.0
.9
.8
.7
.6
.5
.4
.3
.2
.1
A
B
60
80
100
120
140
160
180
200
220
240
TEMP °C

IMPROVED ACRYLONITRILE POLYMER SPINNING PROCESS

CROSS REFERENCE TO RELATED APPLICATIONS

This is a division of application Ser. No. 294,184, filed Oct. 2, 1972, now U.S. Pat. No. 3,984,601, which is in turn a continuation-in-part of application Ser. No. 189,202, filed Oct. 14, 1971.

BACKGROUND OF THE INVENTION

1. Field of the Invention

This invention relates to shapable compositions containing acrylonitrile polymers, a method of preparing such compositions, a method for forming shaped articles therefrom, and filaments and films shaped from the compositions.

2. Description of the Prior Art

Acrylic and modacrylic polymers are well known, and it is known that compositions containing them can be used to form shaped articles such as filaments and films. The process for forming such shaped articles typically involves dissolving the polymer in a solvent, extruding the "polymer solution" through a die or a multiplicity of dies and removing the solvent either in a wet bath or by flow or gas, thus causing or assisting solidification of polymer into shaped structures. These types of extrusion require equipment for removing the solvent and reconditioning it where applicable for future use. The necessity for, and the expense of, such removal and reconditioning, along with requirements for low solvent content in the final shaped article make it highly desirable to provide acrylonitrile polymer compositions suitable for shaping by means other than the wet or gas-flow extrusion of solutions described above. Some modacrylic compositions are theoretically "melt" extrudable into filaments or film form; that is, under high pressures, low rates of extrusion are obtained. However, "melt extrusion" of modacrylics does not appear to have gained commercial acceptance probably due to the poor economics of the low extrusion rates.

Thus, it would be desirable to extrude acrylonitrile polymers from a melt or media which would lessen pollution, extraction, or recycling problems. Some attempts have been made to spin acrylonitrile polymer filaments from mixtures of the acrylonitrile polymer and water. However, such attempts, such as Bynum, U.S. Pat. No. 3,402,231 and Coxe, U.S. Pat. No. 2,585,444, have resulted in fibrillar materials suitable for making paper, or in strands of fused and sintered or foamed particles. They have not resulted in filaments suitable for textile purposes in clothing and rugs and the like.

However, according to this invention, compositions comprising acrylonitrile polymer and small amounts of water have been found economically suitable for extrusion into filaments and films. Such shapable compositions, along with novel acrylonitrile-polymer shaped structures produced therefrom, are provided by this invention.

SUMMARY OF THE INVENTION

1. One aspect of the present invention comprises an extrudable, substantially single-phase composition, comprising water and an acrylonitrile polymer that contains at least about 40 weight percent acrylonitrile, said water being substantially associated with the nitrile groups in the polymer and being present in an amount equivalent as a minimum to either 45% of that required to hydrate all the nitrile groups or 80% of that required to hydrate the coupled nitrile groups (on a 1/1 water molecule/nitrile group basis), whichever is larger, and as an upper limit the amount combined as hydrate at the temperature employed plus 7 weight-% water based on polymer, the total water not to exceed that required to hydrate all nitrile groups.

2. Another aspect of the present invention is a process for preparing the composition described in the preceding paragraph which comprises adding water to the acrylonitrile polymer, said water being added in an amount sufficient to obtain a water/nitrile ratio within the ranges set forth in the preceding paragraph, and heating the resulting composition to the temperature of hydration ($T_h$) under at least autogenous pressure.

3. Still another aspect of this invention is a process for shaping the composition described in the first paragraph of this "Summary" which comprises extruding the composition through an orifice at a temperature between about $T_h - 25°$ C. and about $T_h + 10°$ C.

4. Still one more aspect of the present invention is a filament comprising polyacrylonitrile or a copolymer of 80% by weight or more acrylonitrile and up to 20% by weight of one or more copolymerizable addition monomers, said filament being characterized by a sheath extending inward from the surface of the filament having a thickness of from about 5% to about 50% of the distance from the outer surface of the filament to the central axis of the filament, said sheath having a positive gradient in density, i.e., wherein the highest density is at about the surface of the filament, and said sheath having substantially no "optical" voids. Within the sheath is a core, and in the undrawn filaments the core contains voids having lateral diameters of from about 0.05 to about 1 micron in a concentration of between about $10^5$ and $10^7$/mm.$^2$ of core cross-section.

When as-spun filaments described above are drawn to about 200% or more of their as-spun length (2X hereinafter) the outer surface, or skin, of the sheath develops a number of discrete, generally longitudinal striations having a depth of between about 0.2 and 2.0 microns, a length of between about 15 and 500 microns, and a striation count of about 6 to 20. In drawing, the core voids are elongated and reduced in diameter; the drawn filaments thereby develop a positive form birefringence. The filaments can be annealed, i.e., heated, to reduce the core voids to less than 0.05 micron in diameter, if desired, in which case form birefringence disappears. The drawn filaments also have a Luster Source Ratio of at least 0.7, i.e., they have a structure throughout comprising optically reflective interfaces which result in a unique silk-like, diffuse luster, demonstrable by light-scattering analysis, as will be described further below.

DESCRIPTION OF THE INVENTION

1. INTRODUCTION

Figure 1:
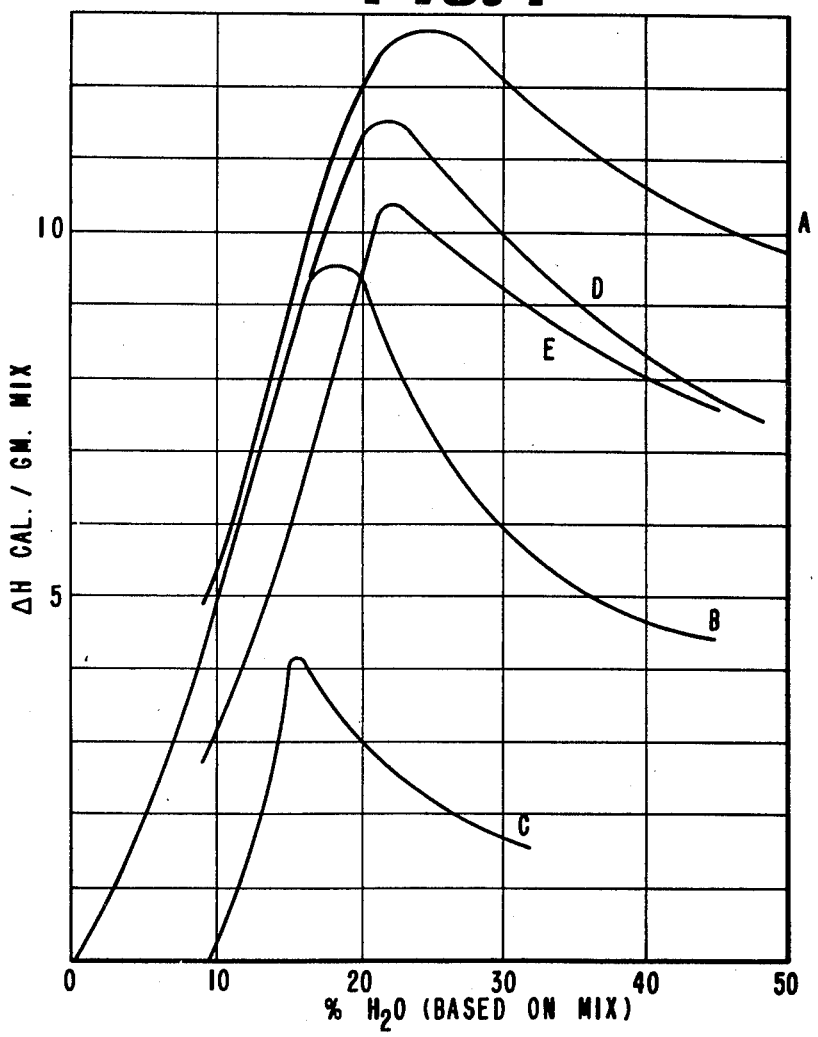
FIG. 1 is a graph which illustrates the use of differential thermal analysis to determine the heat needed to uncouple/hydrate coupled nitrile groups of acrylonitrile polymers.

The term "acrylonitrile polymers" as used herein is defined as those polymers which contain at least 40 weight percent acrylonitrile, i.e., units of acrylonitrile make up at least 40% of the polymer by weight. Thus, the term includes both acrylic and modacrylic polymers.

The terms "acrylic polymer" or "acrylic filament" as used herein mean those polymers or filaments that contain at least 85% by weight units derived from acrylonitrile, i.e., 85 weight percent acrylonitrile. Thus, the term includes the homopolymer of acrylonitrile (vis, polyacrylonitrile), as well as copolymers with one or more comonomers.

Monomers useful for copolymerization with acrylonitrile, i.e., modifiers, include addition-polymerizable monomers such as those containing an ethylenically unsaturated moiety, i.e., methyl acrylate, methyl methacrylate, vinyl acetate, styrene, halogenated styrenes, acrylamide, methacrylamide, methyl vinyl ketone, vinyl pyrrolidone, the vinyl pyridines such as 2-methyl-5-vinyl pyridine, ethylene, sulfonic acids such as styrenesulfonic acid, vinylsulfonic acid, allylsulfonic acid, methallylsulfonic acid, and the amine, alkalimetal or alkaline earth metal salts of such sulfonic acids. Preferred such copolymerizable monomers include methyl acrylate, vinyl acetate, styrene and styrenesulfonic acid and its alkali metal salts.

When these preferred monomers are employed, it is most preferred to employ at least about 90% by weight acrylonitrile in the copolymer. Specifically preferred polymers include those composed of units of acrylonitrile, either vinyl acetate or methyl acrylate, and sodium styrenesulfonate (most preferably only very minor amounts of the latter are used, e.g. about 0.5% or less by weight).

The preferred modification degree is dependent on properties desired in the shaped structure and characteristics, including molecular weight, of the comonomer selected.

The term "coupled nitrile groups" refers to those nitrile groups along the chains of acrylonitrile polymer molecules that are coupled by dipole-dipole interaction, i.e., where one nitrile is attracted to, and associates with, the closest nitrile or nitriles. At ordinary temperatures most acrylonitrile polymers exist in a molecular configuration wherein nitrile groups along one molecular chain are coupled with nitrile groups along one or more adjacent molecular chains. If the polymer is a homopolymer of acrylonitrile, substantially all the nitrile groups are coupled or are capable of coupling under conditions which provide adequate mobility to the molecular structure. If the polymer is a random copolymer containing up to about 15% by weight comonomer units, the presence of the copolymerized units hinders the coupling ability of some of the nitrile groups of the acrylonitrile units and thus reduces the number of coupled nitriles. When the copolymer contains more than about 15 weight percent of the more commonly used modifiers such as methyl acrylate or vinyl acetate, substantially all nitrile couplings are hindered by the presence of the comonomer units.

It will become apparent that the foregoing limitations on comonomer-unit content as influencing coupling of nitrile groups can be only approximate as a generality, although, as will be shown, such limitation can be determined with good precision for any given monomer. Hindering of nitrile-nitrile coupling is a function not only of the number (mol-%) of comonomer units present but also of the size of the comonomer side-group. A small side-group such as the chlorine moiety of vinyl chloride, for example, as the absence of any side-group as in ethylene, results in the disturbance of one nitrile-nitrile coupling (due to the absence of a nitrile group at that position). A large group, on the other hand, such as a phenyl, sulfo-phenyl, or halogenated phenyl group, as examples, can sterically hamper cooling over a considerable length of the polymer chain to which it is attached. With comonomers such as methyl acrylate and vinyl acetate, about 15% modification results in disturbance of essentially all nitrile-nitrile coupling, as noted above, and loss of the acrylic polymer characteristics such as infusibility. As much as 30–35% of vinyl chloride can be incorporated into the polymer, however, without complete loss of acrylic-like properties.

The temperature of hydration, $T_h$, is defined as the minimum temperature at which an operative acrylonitrile polymer/water composition becomes a substantially single phase shapable melt, i.e. sufficient hydration to form a melt will occur with that composition. Water in excess of that which will combine at $T_h$ is tolerable within the limits outlined herein. If the hydrate melt obtained contains less combined water than that combined when all nitrile groups are associated in a 1/1 relationship with water molecules, then additional water can be combined, if present, by raising the temperature. Thus, for any polymeric material the operative temperature may be selected over a range.

If the composition has been raised to an operative temperature, a moderate decrease in temperature up to about 25° C. below $T_h$ can be tolerated without loss of shapability, due to hysteresis in the hydration/dehydration cycle. A moderate increase in temperature, up to about 10° C can be tolerated also, but if excess water is present the formation of additional nitrile group/water associations may thereby result in an altered composition (depending on the relationship between hydration degree and temperature in that temperature range). In general, it has been found preferable to employ a temperature of shaping somewhat lower than $T_h$ and an excess of water within the operable range, as specified. This is detailed further below.

2. THE SHAPABLE SINGLE PHASE COMPOSITIONS

The shapable, single-phase compositions of this invention are substantially partial or complete hydrates of an acrylonitrile polymer as heretofore defined. They are formed only within a definite range of elevated temperatures.

It has been found that if fewer than 45% of all the nitrile groups of the polymer are hydrated, i.e., associated with water molecules, the composition does not have the fluidity or homogeneity required for acceptable extrusion and drawability of the spun product. It has further been found that if any coupled nitrile groups are present, the polymer composition is difficult to extrude if fewer than 80% of the coupled nitriles are hydrated. On the other hand, if water is present in a substantial excess over that capable of hydrating nitrile groups of the polymer at a particular temperature of the composition within the temperature range at which hydration occurs, then the excess water (i.e., water over that amount able to combine with the nitrile groups at the selected temperature) will tend to form a second phase. Minor amounts of such excess water (i.e., up to about 7 weight percent on polymer more than can combine as hydrate at the temperature employed) may be tolerated (a larger excess of water, i.e., about 9–10% excess, may be tolerated if the commonomer units are hydrophilic), but with polymers of acrylonitrile and the more common copolymer modifiers, the maximum water tolerable is that required to hydrate all nitrile groups. It has been found that an excess of water in these ranges is frequently advantageous in the shaping process, since it reduces the viscosity of the hydrate melt, but a gross excess of water is unacceptable; it interferes with extrusion and causes bubbles and shattering of the extrudate, leading to process discontinuities.

Thus, to be practicably shapable into films or filaments, the compositions of an acrylonitrile polymer and water must contain at least about 45% of the water required to hydrate all the nitrile groups, or at least 80% of the water required to hydrate any coupled nitrile groups in the polymer, whichever is greater. It is important that the larger of these two minima be met and that the excess of water (that not combined as hydrate at temperature employed) not increase the total beyond that required to hydrate all nitrile groups. In general, with polymers containing about 7.5 weight percent or less modification by units of one or more of the more commonly used copolymerizable monomers (such as methyl acrylate or vinyl acetate), the minimum about of water needed for good shapability will be 80% of that required to hydrate the coupled nitrile groups. Polymers of higher (i.e., over about 7.5 weight percent) modification with units of such monomers usually require as a minimum that amount of water needed to hydrate 45% of the total nitrile groups.

The compositions to be shaped can readily be formed by adding the exact amount of water required to hydrate between as a minimum either 45% of that required to hydrate all the nitrile groups or 80% of that required to hydrate the coupled nitrile groups (on a 1/1 water molecule/nitrile group basis), whichever is larger, and as a maximum the amount combined as hydrate plus 7 weight-% water based on polymer (observing the limitation not to exceed that amount needed to hydrate all nitrile groups), and heating the mixture under autogenous or higher pressure to the temperature needed to form a substantially single-phase melt (which is indicative of hydrate formation). Alternatively, an excess of water may be added, the composition heated to the desired temperature under autogenous pressure and the excess water removed by either gravity separation (the molten hydrate is heavier than water) or evaporation. After hydrate preparation, the composition will retain its single-phase character at somewhat higher and lower temperatures than that needed for preparation. Thus, the composition once prepared is shapable at a temperature of about 25° C. less to about 10° C. more than the minimum temperature of preparation. Shaping of the composition at a somewhat lower temperature than that needed for preparation of the hydrate accelerates quenching and promotes formation of solid filaments and films.

DETERMINING THE AMOUNT OF WATER NECESSARY

Because the nitrile groups of the homopolymer of acrylonitrile are essentially 100% coupled, the minimum amount of water needed to obtain shapable compositions will be that amount necessary to hydrate 80% of the nitrile groups in the homopolymer. Similarly, because coupling of the nitrile groups in copolymers of acrylonitrile in which the comonomer units comprise about 15 weight percent or more of the more common comonomers is essentially completely hindered, the minimum amount of water needed to obtain shapable compositions of these copolymers will be that amount necessary to hydrate 45% of all the nitrile groups of the polymer. The maximum amount of water which can be accommodated by either the homopolymer or copolymers with the more common monomeric modifiers is about 7%, on polymer, more than that combined as hydrate, not to exceed the overall amount required to hydrate all nitrile groups.

The determination of the minimum amount of water which is consistent with formation of a shapable hydrate of a copolymer of acrylonitrile that contains up to about 15 weight percent comonomer units is not as simple as merely making the calculations of the foregoing paragraph, because these copolymers may contain both coupled and uncoupled nitrile groups. In other words, whether to use as a minimum amount of water either 45% of that required to hydrate all the nitrile groups or 80% of that required to hydrate all the coupled nitrile groups will depend on how many coupled nitrile groups are present in the polymer. To determine how many coupled nitriles are present, differential thermal analysis (DTA hereinafter) of copolymer-water mixtures is carried out. DTA is a means of measuring endothermic or exothermic events in a sample as the temperature of the sample is changed, and the data suggest that the uncoupling-hydration of coupled nitrile groups is an endothermic event. Thus, in a recording of the amount of heat absorbed (i.e., a temperature lag in the "sample" relative to the "blank") as a sample of an acrylonitrile polymer and water is heated by the DTA analysis procedure, the magnitude of any increase in heat absorbed over a certain temperature range is taken as a measure of how much uncoupling-hydration of the coupled nitrile groups has occurred.

By carrying out a series of DTA determinations (the procedure for which is set forth further below) on a given acrylonitrile-polymer/water mixture where the only variable throughout the series is the proportion of the polymer and water present, a graph can be constructed which plots $\Delta H$ (calories absorbed during the uncoupling-hydration of coupled nitrile groups) against the water content (on total mix) of the sample being tested. Such a plot is shown in FIG. 1, where curves A through E represent the plots for five different acrylic polymers. The curve marked A represents the data for polyacrylonitrile, wherein essentially all the nitrile groups are coupled. Thus, the $\Delta H$ maximum value for this curve is believed to represent the heat in calories involved in uncoupling-hydrating every coupled nitrile in a gram of an essentially completely coupled polymer. If the polymer employed is a copolymer there will be a lesser number of coupled nitriles present (as explained above, the presence of comonomer units hinders nitrile coupling), and the $\Delta H$ maximum for such copolymers will necessarily be less than the $\Delta H$ maximum for polyacrylonitrile. By taking the ratio of Δ H maximum for any copolymer to Δ H maximum for polyacrylonitrile, the weight fraction of the copolymer which is coupled acrylonitrile residues is obtained.

Table 1 lists the five acrylic polymers whose DTA curves are shown in FIG. 1, along with the calculated amount (weight percent on polymer) of water that is needed to hydrate all the nitrile groups in the polymer, and the Δ H maximum value for each polymer. From this Δ H data, the amount (weight percent on polymer) of water needed for hydration of all the coupled nitrile groups in the polymer is calculated.

The values plotted in FIG. 1 are chosen to make determination of maximum Δ H more precise; i.e., by expressing Δ H in terms of calories per gram of mix, Δ H decreases with additional water beyond that required to hydrate the coupled nitrile groups, clearly identifying the maximum Δ H. Once the maximum value has been determined for a given polymer, it is more useful to express Δ H in terms of calories per gram of polymer; the most accurate determination of water requirement is derived from these values as follows (illustrated for polymer B):

$$\frac{11.7}{17.1} \times 34 = 23.3 \text{ parts water/100 parts polymer}$$

TABLE 1

| FIG. 1 Curve | Polymer Composition (wt.-%)* | Calculated % Water Needed for Complete Hydration** | Δ H Maximum (cal/gm of mix) | Δ H Maximum (cal/gm polymer) | DTA-Determined % $H_2O$ for Hydration of Coupled Nitrles** |
|---|---|---|---|---|---|
| A | AN (100) | 34 | 12.8 | 17.1 | 33.3 |
| B | AN/MA/SSS (93.6/6/0.37) | 31.8 | 9.5 | 11.7 | 23.3 |
| C | AN/MA/SSS (87.6/12/0.4) | 29.7 | 4.2 | 5.0 | 9.9 |
| D | AN/SSS (98/2) | 33.3 | 11.5 | 14.7 | 29.2 |
| E | AN/SSS (96/4) | 32.6 | 10.4 | 13.5 | 26.8 |

*AN = acrylonitrile; MA = methylacrylate; SSS = sodium styrenesulfonate
**parts water per 100 parts polymer As can be seen from FIG. 1, the empirically determined water needed for complete hydration of polyacrylonitrile (25% on mix; 33.3% on polymer) is in agreement with the calculated amount needed. It is also seen from the tabulated "DTA-Determined % $H_2O$ for Hydration of Coupled Nitriles" that the number of coupled nitriles in the copolymers B–E is less than the total number of nitrile groups present, which illustrates the hindering effect on coupling caused by the presence of the comonomer units.

With data of the foregoing type in hand, one can calculate how much water is needed to hydrate 80% of the coupled nitrile groups and how much water is needed to hydrate 45% of all the nitrile groups. The minimum amount of water needed then for this type of copolymer will be that amount which meets both criteria, in other words, the greater of the two amounts.

Illustration of this calculation for Polymer B is as follows:

80% of coupled: $0.8 \times 23.3 = 18.64\%$ water

45% of all nitriles: $0.45 \times 31.8 = 14.31\%$ water

Thus, it is seen that the minimum water for a Polymer B hydrate melt should be chosen as 80% of that required to hydrate the coupled nitriles. For Polymer C, however, the "80% value" is 7.9% while the "45% value" is 11.4%, showing that for this polymer the minimum water should be chosen as 45% of that required to hydrate all nitrile groups present.

DETERMINATION OF THE HYDRATION TEMPERATURES

The shapable compositions discussed in the preceding section cannot be formed by simply adding an amount of water within the required range to the acrylonitrile polymer, because the hydrates are formed only at elevated temperatures. The required elevated temperatures can be determined for any acrylonitrile polymer either by visual means or, more accurately in many cases, by Laser Raman Spectroscopy.

The temperature can be approximated visually by adding the necessary amount of water to the polymer in a heavy-walled glass tube, sealing the tube and heating the mixture. As the mixture is heated, the polymer appears to remain substantially in a dry powder form until hydration begins, whereupon the polymer becomes a somewhat turbid, visually uniform fluid. The turbidity diminishes upon heating to the still-higher temperature required for completion of the hydration of all the nitrile groups, provided sufficient water has been added to allow complete hydration.

The more accurate means of determining the hydration temperature range involves the use of Laser Raman Spectroscopy (LRS hereinafter). LRS is a means of quantitatively determining certain types of bonds by analysis of the spectrum of scattered radiation resulting from exposure of a heated sample to a laser beam. By carrying out the LRS analysis (the procedure for which is set forth further below) on a sample of an acrylonitrile polymer in water, data is obtained from which a graph can be constructed which shows the amount of nitrile bonds present in the sample as a function of temperature. The graph can also be used to show the amount of hydrated nitrile groups present.

Figure 2:
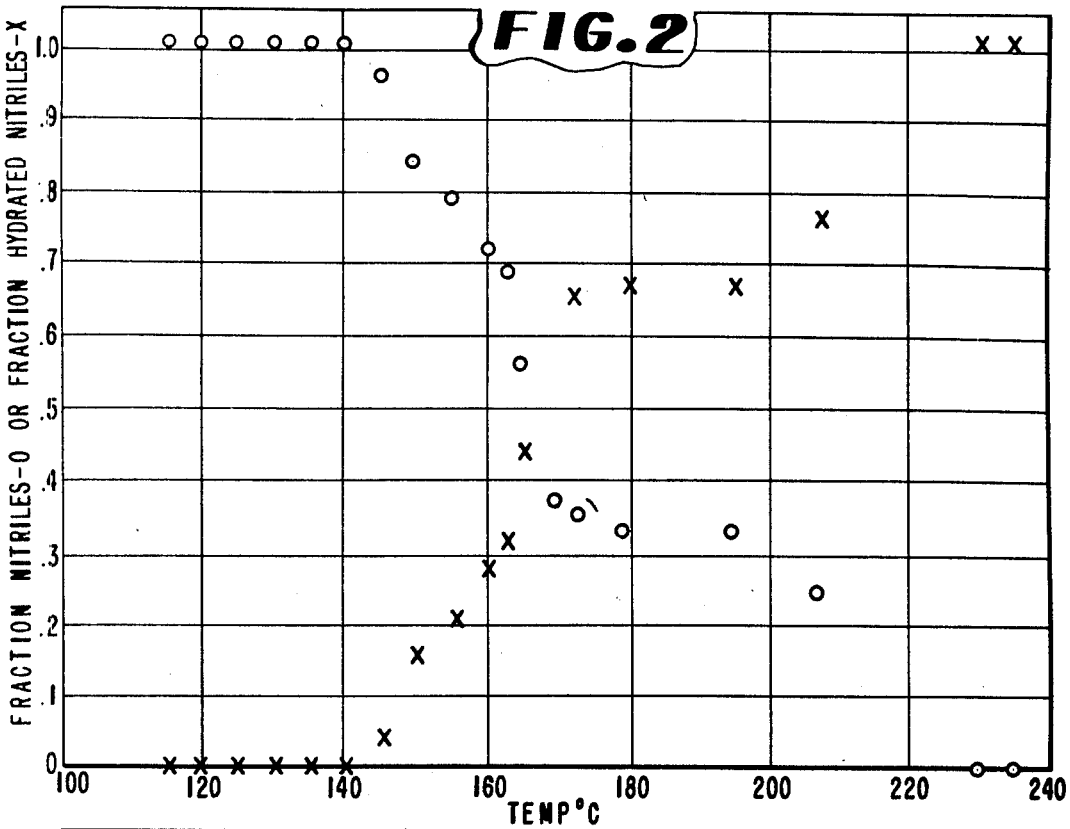
FIG. 2 is a plot of Laser Raman Spectroscopy data which indicates the degree of nitrile hydration of an acrylonitrile polymer as a function of temperature.
Figure 3:
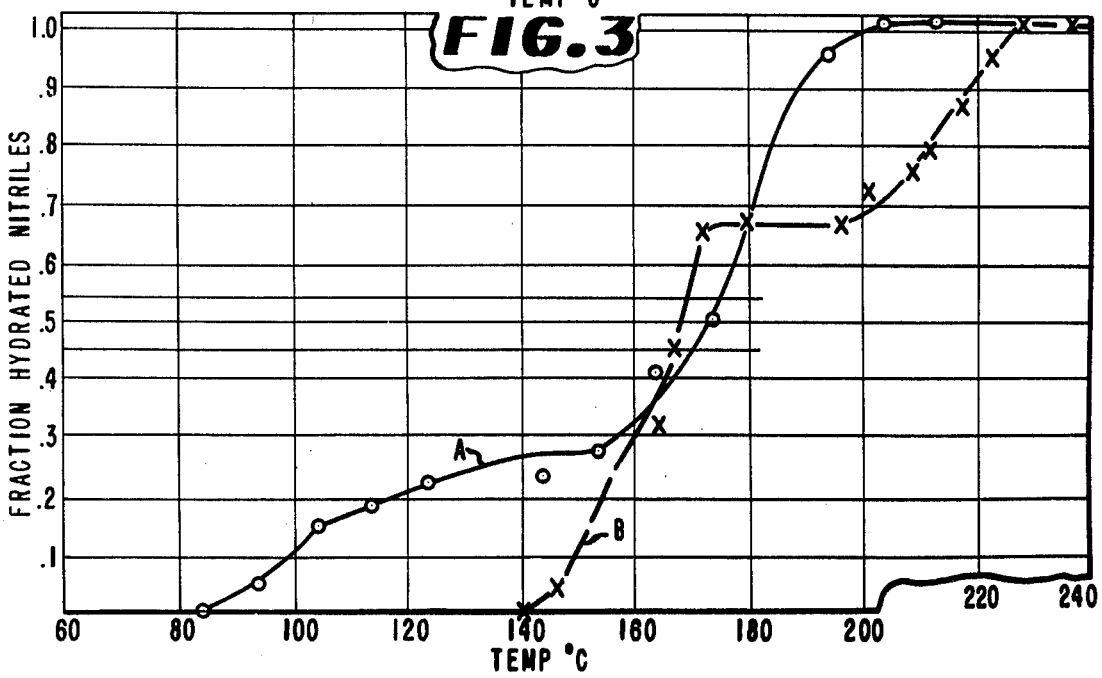
FIG. 3 is a plot of Laser Raman Spectroscopy data which indicates the degree of nitrile hydration of two acrylonitrile polymers as a function of temperature.

FIGS. 2 and 3 are plots of data obtained by LRS. FIG. 2 is a plot of LRS data obtained on a sample of copolymer B of Table 1. In FIG. 3, the curve marked "B" is a plot of the same LRS data, and the curve marked "A" is a plot of LRS data obtained on a copolymer of acrylonitrile/vinyl acetate/sodium styrenesulfonate in a weight ratio of 93.95/6/.05.

As seen in FIG. 2, an LRS analysis of copolymer B of Table 1 reveals that as the temperature is raised the nitrile band (2234 $cm^{-1}$), which is denoted by the circles, begins to disappear at about 140° C., i.e., the nitrile concentration begins to decrease. The nitrile band reaches a plateau between about 170° C. and 190° C., then, as heating continues, finally disappears at about 225° C. Concurrently, a new band at 2050 $cm^{-1}$, which is denoted by the *x*'s, appears at about 140° C., rises to a plateau between about 170° C. and 190° C. and reaches a maximum at about 225° C. It is seen that the plateau temperature of each is between about 170° C. and 190° C. and that the intensity of the nitrile band at this plateau is about ⅓ of its initial intensity, while the intensity level of the new band at the plateau is about ⅔ that of its maximum. Since the intensity of each band is expressed as a fraction of the maximum observed intensity of the band, and since the height of the plateau in the hydrated curve (⅔ of maximum) approximates the value of the ratio of Δ H for said copolymer B to Δ H for polyacrylonitrile (11.7/17.1 = .68), these data may be interpreted as suggesting that the plateau defines the range of temperature to uncouplehydrate the coupled nitriles of the polymer. The figure also suggests that as the hydrated nitrile curve continues to increase past the plateau and the nitrile curve continues to decrease, the uncoupled nitriles also become associated with water; this hydration is not monitored by the DTA analysis as described.

Not all acrylic copolymers exhibit a plateau suggestive of hydration of coupled nitriles. For example, copolymers of acrylonitrile and vinyl acetate or methyl vinyl pyridine appear to hydrate in the reverse sequence from that of the copolymer depicted in FIG. 2, i.e., they appear to hydrate by hydration of the uncoupled nitriles first, followed by hydration of the coupled nitriles. Vinyl acetate copolymers appear identical to their methyl acrylate counterparts in DTA analysis but appear very different in LRS analysis. This is illustrated by FIG. 3, which is a plot of LRS data from a terpolymer of acrylonitrile/vinyl acetate/sodium styrenesulfonate in a weight ratio of 93.95/6/0.05 as Curve A. Curve B is a plot of the hydrated-nitrile data of FIG. 2, and has been inserted into FIG. 3 to aid in the discussion of Curve A.

To determine the lowest operable temperature at which a shapable hydrate can be formed for any given acrylonitrile polymer, a horizontal line is drawn on the LRS graph at the 0.45 value for Fraction Hydrated Nitriles and another horizontal line is drawn at the Fraction Hydrated Nitriles value which corresponds to 0.8 times the fraction of coupled nitriles present (as calculated from the DTA ratios). Each horizontal line is drawn to intersect the Laser Raman data curve representing that polymer. The higher of the two temperature values for these intersections has been found empirically to be about the minimum temperature at which a spinnable hydrate composition can be formed.

The maximum temperature required to form the substantially single-phase hydrates will be that temperature at which all the nitriles are hydrated. Thus, by reading from the LRS graph the temperature at which all the nitrile groups are hydrated (where the fraction of nitriles hydrated equals 1), the temperature required for a fully hydrated composition is found.

If the foregoing procedures for determining the amount of water necessary and the hydration temperature are followed, the extrudable hydrate obtained is one that is referred to herein as a substantially single-phase composition. Of course, additives may be present provided they do not alter the characteristics of the composition hereinbefore described. These additives are ones known in the art to modify the filaments and films obtained and will be discussed further below. In addition, it has been found that the substantially single-phase compositions may be advantageously diluted with a minor proportion of a solvent for the polymer, i.e., in the range of 0.5–10% by weight based on the weight of acrylonitrile polymer employed. The solvent has the effect of reducing melt viscosity and also leads to filaments of improved transverse (loop) properties. Such solvents include 2-pyrrolidone, ethylene carbonate, propylene carbonate, propiolactone, γ-butyrolactone, α-valerolactone, γ-valerolactone, dimethylformamide, dimethylacetamide, N-acetyl morpholine, methyl ethyl sulfone, tetramethylene sulfone, tetramethylene sulfoxide, methyl ethyl sulfoxide, dimethyl sulfone, dimethyl sulfoxide, acetonitrile.

Inherent viscosities of the acrylonitrile polymers usually range between 0.4 and 2.0 as measured at 30° C. in a solution of 0.5 gm. polymer in 100 cc. of dimethylformamide. Preferably, the inherent viscosity will be in the range of 0.7 to 1.1. Intrinsic viscosities are determined at 25° C. in a 0.2-molar solution of lithium bromide in dimethylformamide as solvent. Preferably, the intrinsic viscosity will be in the range of about 0.8 to 1.1.

3. EXTRUSION (SHAPING) OF THE COMPOSITIONS

It has been found that the shaping temperature may vary from the minimum temperature of hydrate formation by up to −25° C. and about +10° C. Too low a shaping temperature may cause discontinuities during extrusion or may result in a shaped article of poor quality, e.g., one containing frequent bubbles, because a part of the water will be in excess of that combined at that temperature (as is apparent from the LRS plot). If a temperature in the lower part of the operable range is used for shaping of a composition having a degree of hydration of the polymer near the minimum required, then it is preferable to use a polymer of lower inherent viscosity than would be used at shaping temperatures in the higher part of the range for compositions in which the amount of water present is near the maximum permissible.

On extrusion, there may be some tendency for bubbles to appear in the extruded structure. The formation of such bubbles can be minimized by forced cooling of the emerging shaped structure or by use of pressure around the extrudate for a short time after extrusion. Deaerating the composition prior to extrusion is also useful. The deaeration can be carried out either by freezing the composition and evacuating the container, then reheating, or by processing the composition in a suitable screw-type extruder.

The single-phase hydrate compositions have sufficient stability under autogenous or higher pressures and at temperatures in the range discussed above to be extruded, as set forth above and in the examples below.

4. TEST PROCEDURES FOR PREPARING THE COMPOSITIONS

DTA Analysis Procedure

1. A polymer/water mixture (5–10 mg.) of known composition is rapidly transferred to a small aluminum cup and sealed hermetically. The cup is capable of withstanding a bursting pressure of 45 psig. (3.15 kg./cm.$^2$).

2. The sample cup is placed on one loop of the differential thermocouple in a "Stone" DTA Cell [Tractor Model SH-15BR2-Ni, which has a capability of 3000 psig. (210 kg./cm.$^2$) internal pressure at 500° C.]. An empty sealed cup of the same type is placed on the other loop in the cell to serve as the reference side of the system.

3. The cell is assembled, pressurized to 500 psig. (35 kg./cm.$^2$) with nitrogen, to minimize the chance of water loss from the sample cell as a result of any small leak, and preheated at maximum furnace power for 2 minutes. The furnace is a Tracor ("Stone") Model HP-202.

4. The temperature program is initiated (nominally 22.5° C. temperature rise per minute).

5. The cell is allowed to traverse the temperature range of interest while thermally induced events are recorded simultaneously on a strip chart recorder and on an X–Y plotter.

6. The peak area on the strip chart record is determined by use of a polar planimeter, and the corresponding heat of reaction is calculated by comparing this area with that generated by analysis of a reproducible standard (e.g., indium metal, which melts at 157° C.; $\Delta H =$ 6.79 cal./gm.). The $\Delta T$/time curve is integrated from the first detectable deviation of the baseline from steady state to the point where the curve appears to have reestablished steady state after completion of the reaction, the baseline being linearly interpolated during the transition interval itself. The complete expression for heat of reaction (cal./gm. of polymer) is given by:

$$\Delta H \text{ (cal./gm. of mix) sample} = \frac{\text{(area) sple.}}{\text{(area) std.}} \times \frac{\text{(wt.) std.}}{\text{(wt.) sple.}} \times \frac{\text{(}\Delta\text{ T sensitivity) sple.}}{\text{(}\Delta\text{ T sensitivity) std.}} \times \frac{\text{(chart speed) std.}}{\text{(chart speed) sple.}},$$

$$\Delta H \text{ (cal./gm. polymer)} = \frac{\Delta H \text{ sample (cal./gm. mix)}}{\text{wt. \% polymer in sple.}} \times 100$$

std. = standard; sple. = sample

Reaction temperatures may be read directly from the temperature axis of the X–Y plotter, which records output of a thermocouple located in the sample chamber.

Pertinent transition temperatures may be read from the extrapolated intersection of the steady state baseline before initiation of the transition with the low-temperature edge of the endothermic peak.

EMF values are converted to temperatures utilizing published data for "Platinel" II (referenced to 0° C.) according to Olsen & Freeze, J. Nat. Bur. Stds. 68c 272 (1964).

The polymer/water ratio in the analyzed sample is determined thermogravimetrically by heating a separate sample to dryness in a stream of nitrogen.

LRS ANALYSIS PROCEDURE

The LRS procedure is as follows: a sample of the particular acrylonitrile polymer one desires to use combined with about 50% of its weight of water (excess water is without significant effect in this analysis) is sealed in a quartz tube after freezing and evacuating to the pressure corresponding to the vapor pressure of water at that temperature. The tube is mounted in a furnace in contact with a calibrated ironconstantan thermocouple and heated through the temperature range of interest by means which permit gradual adjustment of temperature and holding at a given temperature for the time required to scan the spectrum of scattered radiation.

The sample is excited by an Argon Ion Laser ($\lambda =$ 4880A) operating at 200 milliwatts or less. The spectrum of scattered radiation is scanned at each temperature of interest using a "Spex" Model 1400 double monochromator. Scattered radiation at the selected wavelength is allowed to fall on an "E.M.I."-9558QM photomultiplier tube, the output of which is measured by a photocounter (Solid State Radiation Company Model 1120) and recorded on a strip-chart recorder.

5. THE SHAPED ARTICLES

Filaments and films can be shaped from the substantially single-phase acrylonitrile polymer/water compositions.

When filaments are prepared containing at least 80% by weight or more units of acrylonitrile and up to 20% by weight of one or more copolymerizable addition monomers, such filaments are characterized by a sheath surrounding a core in which the sheath has a positive gradation in density, i.e., the density increases toward the surface of the filament. All the filaments of this invention contain the sheath, which has a thickness of about 5% to 50% of the distance from the outer surface to the axis of the filament, and which exhibits the positive graduation in density from a low near the sheath-/core boundary to a high at the surface of the filament. Such a structure confers high bending modulus and bulk to the filaments of this invention and leads to surface striations on drawing which gives a dry hand and, in aggregates of these filaments promotes high water-absorption rates.

The density gradient in the sheath is believed due at least partly to the presence of a multitude of submicroscopic voids that are more densely concentrated toward the core of the filament than they are toward the outer surface. The voids in the sheath are too small to be seen by optical or the usual scanning electron microscopic techniques, i.e., smaller than about 0.05 micron in diameter, but they are detectable by transmission electron microscopy at magnification of 70,000X or more. The gradient amounts to a density drop of at least about 0.001 g/cc per 10% of weight of fiber removed from the outermost portion of the filament.

As the filaments of this invention are spun, they develop voids in a core portion of the filament, which appear to be closed-cells as observed under microscopic examination. The void concentration is between about $10^5$ and $10^7$/mm.$^2$ of core cross-section and the voids range in diameter from those barely resolved (having a diameter of about 0.05 micron) in a scanning-electron micrograph to a maximum of about 1 micron. These voids which are seen in scanning-electron micrographs are sometimes referred to herein as "optical voids." These void-containing filaments can be heat-annealed after drawing to "heal" the "optical voids," but what appear to be vestiges of the voids are detectable by transmission electron microscopy at higher modification. They are also inferred from light scattering data.

A unique characteristic of all the drawn filaments of this invention is a very desirable, diffuse, visible-light reflectivity, or luster, which closely resembles that of silk. This luster characteristic is due primarily to the unique internal morphology of these filaments, including the voids and/or vestiges of voids (the luster survives to a significant extent any annealing employed to eliminate optical voids). The Luster Source Ratio is a means of assessing the importance to luster of the internal light-scattering interfaces relative to that of the filament-surface configuration. The filaments of this invention have a Luster Source Ratio of at least about 0.7, ranging to about 3.5 or more.

When any of the as-spun filaments of this invention, whether voided-core or annealed, are drawn to about 200% or more of their as-spun length, the skin of the filament develops multiple striations along the longitudinal axis of the filament. Each striation has a depth between about 0.2 and 2.0 microns, a length of between about 15 and 500 microns and the striation count is from about 6 to 20. The skin can be up to about 5 microns thick. It is believed that the striations develop in this skin portion of the sheath because the skin is highly oriented, denser and, therefore, less drawable than the remainder of the sheath or the core. The striations are believed to contribute to the superior dyeability of the drawn filaments of this invention relative to the undrawn. The drawn filaments dye about as well as art-known acylonitrile-polymer filaments even though the dense skin of the filaments of this invention would be expected to act as a substantial barrier to dyes. The striations are also believed responsible for the ability of aggregates of these drawn filaments to transport, i.e., absorb, water at a rate several times that of filaments comprising the same acrylonitrile polymer that have been wet or dry spun by previously known procedures.

The drawn filaments can also be annealed, i.e., wetted and heated at a temperature of about 170° to 200° C., to "heal" the optical voids in the filament. The annealed filaments still retain the positive density gradient and the diffuse luster which is taken as an indication that submicroscopic voids (i.e., voids less than 0.05 micron in diameter) or their light-scattering vestiges are still present in the filament.

Filaments of 1000 denier or more can be prepared by the procedures of this invention as well as the more ordinary textile-denier filaments.

The shaping of the substantially single-phase compositions of this invention is unique in several respects. One of the more striking characteristics is seen as the nearly instantaneous solidification of the extrudate. It is evident that there is virtually no tendency for extruded filaments to collapse toward the "natural," round cross-section. Consequently, filaments shaped from the compositions have cross-sectional shapes which closely duplicate the relative cross-sectional dimensions of the spinneret capillaries used to shape them. One advantage of such instantaneous solidification lies in the capability to produce filaments of certain shapes which are impossible or difficult to produce by usual melt, wet- or dry-spinning means. A further advantage of the instantaneous solidification of extrudate is seen in the complete absence of fused or "twinned" filaments. The slower solidification of extrudate in processes heretofore known has required wider spacing of capillaries in the spinneret, and careful control of cooling or evaporative gas flow, to avoid merging of streams of extrudate, or "twinning". Such limitations are virtually absent in shaping compositions of this invention.

The film of this invention, when prepared in the form of an extruded tube, are characterized by a sheath in the surface portions of the film which "sandwich" an interior core. The interior core contains voids of the same general description as the voids in the filaments of this invention, and the sheath portions exhibit a higher density than that of the core.

6. TEST PROCEDURES FOR DETERMINING FILAMENT PROPERTIES

Luster Source Ratio

A dimensionless parameter, termed Luster Source Ratio (LR) is a convenient base for comparison of the drawn filaments of this invention with those of the prior art. It is developed by light-scattering measurements as described below, using a "Sofica" Light-Scattering Photometer, Type 701, obtained from Mechrolab, Inc., Mountainview, California, modified slightly to permit (1) reproducible positioning of single, straight filaments or arrays of (randomly twisted) filaments, (2) determination of light scattering patterns of filaments (or multi-filament arrays) immersed in either air or a liquid of matching refractive index and (3) improved baffling to minimize the effect of stray light.

The filaments to be tested are boiled off for 30 minutes in a 0.1% "Duponol" WA solution, rinsed in distilled water, dried in a forced-draft oven for 1 hour at 40° C. and further conditioned for 16 hours at 21° C., 65% R.H.

To measure LR, two to four filaments (depending on denier, not critical) are mounted in a close parallel array in a perforated holder such that the sample may be angularly adjusted relative to the plane which includes the incident light slit. For this test, the filaments are oriented parallel to the scattering plane. The incident light is a narrow beam of monochromatic green ($\lambda$ = 545 m$\mu$), unpolarized light. Light scatttered by the filament is measured by a photomultiplier and recorded on a graph of log intensity vs. angle relative to the incident beam. A maximum intensity is seen at some angle near 45°. The pattern of the ascending and descending slopes around this maximum intensity is characteristic of the particular filament. A horizontal line is drawn on the graph, at one-half the value of the maximum intensity, to intersect the ascending and descending legs of the intensity curve. The distance, in degrees, between these two intersections, termed Full Width, Half Mode (FWHM) is a convenient reference to the luster of a given filament.

The above procedure is repeated after immersion of the sample in a 50/50 mixture of ortho- and para-xylene (selected to approximate the refractive index of the acrylonitrile polymer filament). The ratio of FWHM in air to that in xylene is termed LR. Filaments of this invention have an LR of 0.7 or more, suggesting a large dependence of light scattering on the internal (core plus sheath) morphology typical of the products of this invention.

CROSS-SECTION DYEING

This test indicates a sheath-core morphology by demonstrating a difference in dye receptivity between sheath and core, and in connection with other tests described herein, confirms a density differential. 1. The filaments are scoured for 30 minutes at the boil in an aqueous solution of 1 gm./liter of a commercial anionic surfactant to remove finish. Several filaments are then compressed in the aperture of a Hardy plate and cut on both sides to leave both ends of 500-micron-long filaments exposed at the surfaces of the plate.

2. An aqueous dye bath is prepared to contain 0.005 gram of an anionic surfactant, 0.01 gram acetic acid, 0.2 gram sodium sulfate and 0.04 gram CI Basic Blue 4 in 40 ml.

3. The bath is heated to 180° to 210° F. (82° to 99° C.) and the Hardy plate immersed therein for a few seconds. (The required time of immersion will depend on the dye receptivity of the filament. If a deep, uniform dyeing occurs, the time should be reduced until a light, overall dyeing illustrates that no differential in dyeing rate exists for that sample or until a differential is found.)

4. The Hardy plate is removed from the bath, rinsed thoroughly in warm water and dried.

The difference in the dyeing of the sheath and the core will readily be apparent in filaments of this invention due to a deeply dyed core and an essentially undyed sheath when filaments are analyzed by the foregoing procedure.

By measuring the sheath, its thickness can be determined on the cross sections dyed in this procedure.

DENSITY OF SURFACE FRAGMENTS

The higher density of fragments taken from the surface of filaments of this invention is shown as follows: Surface fragments for density determination are taken from a bundle of up to about 40 filaments spread on a glass plate or other plane, hard surface to form a flat ribbon of closely parallel filaments. The filaments are held in place by suitable means, and a sharp razor blade, held perpendicular to the filaments, is brought into gentle contact with them. The blade is then moved along the filaments once only, so as to scrape a small amount of surface material from the filaments. The surface material is transferred to a sodium bromide density gradient tube prepared as known in the art. A small segment of the original filament is also put into the same density gradient tube so that the difference between surface-fragment density and overall filament density may be observed directly. If more surface fragments are needed than are obtained by a single pass of the razor blade, more material is obtained by scraping fresh lengths of the same filaments.

DIFFERENTIAL SOLUBILITY RATE

A difference between the sheath portion and the core portion of filaments of this invention, whether or not an optically voided core is present, is further confirmed by a difference in the rate of solubility between the sheath and the core portions. The core portion of the filament dissolves more readily.

Cross-sections of about 6μ thickness are used in this test. Filaments are embedded in an epoxy resin, cross-sectioned and mounted under a cover glass on the stage of a microscope. Several sections are brought into the field of view. A drop of active solvent, e.g., dimethylformamide, is placed at the edge of the cover plate and allowed to flow across the surface of the cross-sections. Within a few minutes, it becomes apparent that the core portion of the filament cross-sections have been dissolved, while the outer, sheath, portion remains intact substantially longer.

Differential solubility is also evident in the treatment of short filament lengths with solvent. In this procedure, a few filaments having a length-to-diameter ratio of at least about 10 are arranged under a microscope cover glass in the field of view and a drop of solvent placed at the edge of the cover glass. The center portion of each filament end is attacked first by the solvent whether or not a voided core is present, and it will be noted after a few minutes that the filaments are hollow over a substantial portion of their length. With increasing exposure, the surface portions of the filaments begin to fibrillate and ultimately dissolve.

Characteristics of the striations in the drawn filaments of this invention are determined by the following tests.

STRIATION LENGTHS

The lengths of the striations in the skin (i.e., the outermost portion of the sheath) of filaments of this invention are measured on a montage made up of scanning electron micrographs. A short length of the filament is metalized and mounted in the scanning electron microscope following standard procedures. A series of 10–12 slightly overlapping pictures is made along the filament at about 1200X magnification. These are trimmed and fastened together to form a continuous picture of the filament 80 to 85 cm. long, covering an actual filament length of about 700μ. The diameter of the filament image is divided into 4 equal strips, and all measurements and counts are made in the central two quarters (or half) of the filament image. Striations are represented by dark longitudinal streaks extending generally in the direction of the filament axis. The beginning and end of a striation are characterized by narrowing of the dark streak to extinction between lighter prominences, or by more abrupt termination at a lighter blockage. The picture montage is first examined to find the longest, and then the shortest, striation included in the center half-image, and both are measured. Then seven striations are randomly selected at each of three locations, near each end and the center of the montage. The lengths of these striations are also measured. The 23 measurement are averaged to find the average striation length for the filament.

STRIATION COUNT

The number of striations in a filament is estimated by examination of the micrograph made for use in measuring striation length. A count is made of the number of striations found in the center half of the filament image, along lines drawn approximately perpendicular to the filament axis. A striation is taken to be a dark line or area found between two lighter lines or areas representing prominences. Counts are made along three lines drawn at random intervals in each of the three areas used in measuring striation lengths. The nine values obtained are averaged to find the striation count for the filament.

STRIATION DEPTH

To measure the average depth of the striations, the filaments are embedded in epoxy resin, cross-sectioned, and examined under the microscope by standard methods. Photomicrographs are made at 1500 to 2000X magnification. For filaments having a substantially round cross-section, the center of the circular section is located by trial and error. By means of a compass, a circle is drawn which touches or cuts slightly below the tops of the majority of the larger prominences between the striations. Using the same center, a second circle is drawn which touches or cuts slightly above the bottoms of the majority of the deeper striations. The radial distance between the two circles is taken as a measure of the depth of the striations in the surface of the filament. This distance may be expressed as a percentage of the radius of the larger circle; alternatively the distance measured may be calculated in absolute units by reference to the degree of magnification used in making the photomicrograph.

For filaments whose cross-sections deviate from circularity, segments of the perimeter are selected which approximate the arc of a circle, whose center is again determined by trial and error, and arcs of circles are drawn as before. The radial distance between the arcs is converted to absolute striation depth by taking into account the degree of magnification used in making the photomicrograph.

STEPWISE REMOVAL OF SURFACE LAYERS

The density gradient in the sheath of fibers of this invention can be shown by removal of varying amounts of the filament surface and measuring the density of the residue after each stage of removal. Two methods have been employed for both solvent-stripping and density determinations. No substantial differences are seen in accuracy among the various permutations of these analyses, and choice is primarily based on convenience considerations. The procedures are as follows.

DENSITY DETERMINATIONS METHOD A

Samples of continuous-filament yarn to be tested are prepared by loosely winding the yarn around a large test tube or by other means to form skeins of about 1-inch diameter. The skeins are wrapped in cheesecloth to retain skein integrity while being boiled in distilled water for one-half hour; they are dried overnight under a pressure of about 20 mm. Hg with a slow flow of air at room temperature and accurately weighed.

The apparent density (i.e., the density of the filament in air) is determined as follows:

Several of the skeins are immersed in a suitable liquid such as methanol or water and accurately weighed as soon after immersion as is practicable. A series of additional weighings is made at increasing immersion times up to about 4 or 5 minutes. The apparent density at each time of immersion is calculated as follows:

$$\rho = \frac{W_{air}}{V} = \frac{W_{air}}{\dfrac{W_{air} - W_{liq}}{\rho_{liq}}}$$

wherein $\rho$ = apparent density of the filament
$W_{air}$ = weight of the filament in air
V = volume of the filament
$W_{liq}$ = weight of the filament while immersed in the liquid
$\rho_{liq}$ = density of the liquid at the temperature of weighing A plot of apparent density vs. time is prepared for each skein and the line best representing the points extrapolated to zero time. The density at zero time is taken as the apparent density in air.

SOLVENT-STRIPPING METHOD A

The remaining skeins are immersed in a suitable solvent and gently agitated for varying lengths of time. The solvent and its temperature should be selected to result in a convenient rate of etching of the filament being tested; a weight loss of about 10–20% in 8–10 minutes has been found satisfactory. Dimethylformamide at room temperature is suitable for most acrylic filaments. The skeins are removed at suitable time intervals, rinsed quickly with clean solvent, washed thoroughly in distilled water and redried as above-described. The weight in air and apparent density of each etched skein are determined as described for the unetched skein. By comparison with the weight of the unetched skein, the % weight loss in etching is calculated for each skein.

DENSITY OF RESIDUAL PORTION

A plot of the apparent density, determined on each etched skein as done above for the unetched skein, vs. weight percent residue reveals a progressive decrease in density of the residues with additional etching for the filaments of this invention (positive density gradient).

DENSITY OF PORTION REMOVED

It is recognized that the foregoing results do not adequately distinguish over a hypothetical filament which comprises a core of one uniform density and a sheath of another, uniform, higher density. An alternative handling of the data provides the needed distinction although it is inherently less precise than the foregoing method. In the alternative method, density of the portion removed is calculated as follows:

$$\rho_D = \frac{W_1 - W_2}{\dfrac{W_1}{\rho_1} - \dfrac{W_2}{\rho_2}}$$

wherein $\rho_D$ is density of the dissolved increment,
$W_1$ is weight of the filament before increment removal,
$W_2$ is weight of the filament after increment removal,
$\rho_1$ is the apparent density of the filament before increment removal, and
$\rho_2$ is the apparent density of the filament after increment removal.

Despite a larger scatter of data, as would be expected with this method, the positive gradient in density is clearly seen in filaments of this invention. Prior art filaments tested show either no change or a slight negative gradient in apparent density of this test using either method of data plotting.

SLOPE OF RESIDUE DENSITY VS. % RESIDUE

The assessment of the results of the foregoing analyses can be freed from any question of interpretational bias by use of the "least-squares" method of slope determination as well known in the art. This method is most convenient when used with a suitable computer program, of course, but is useful as an occasional check of objectivity in the interpretation of data. The results of such handling are reported herein as "Slope - $\Delta\rho$/10% Removed," referring to density change in the residual filament.

SOLVENT-STRIPPING METHOD B

Filaments of known overall density are cut to convenient lengths, carefully weighed and immersed in a suitable solvent for varying lengths of time. The solvent and its temperature should be selected to result in a convenient rate of solution for the filament being tested; dimethylformamide at room temperature, for example, is a suitable solvent for a copolymer of acylonitrile/methyl acrylate/sodium styrenesulfonate.

The filaments are removed from the solvent at time intervals established by trial to result in dissolution of several increments of filament surface within the range over which the density gradient is to be determined. After removal, the filaments are carefully washed, dried and weighed.

DENSITY-DETERMINATION METHOD B

A sample of each residual filament is placed in a suitable density gradient tube as taught in the art and allowed to equilibrate, with appropriate density standards, for 24 hours. Referring to the position of the density standards, the tube is calibrated and the density of each filament residue is read. Density of the stripped portion is calculated as follows:

$$\text{Density of dissolved part} = \frac{W_1 - W_2}{\dfrac{W_1}{\rho_1} - \dfrac{W_2}{\rho_2}}$$

wherein $W_1$ is the weight before removal of the increment, $W_2$ is the weight after removal of the increment, $\rho_1$ is the density before removal of that increment and $\rho_2$ the density after removal.

Results of the Methods B analyses can be handled by any of the procedures outlined under descriptions of Methods A.

7. THE EXAMPLES

In the Examples which follow, all parts and percentages are by weight unless otherwise indicated.

EXAMPLE 1

Onto 100 parts of a copolymer of 93.63% acrylonitrile, 6% methyl acrylate and 0.37% sodium styrenesulfonate, 25 parts of water is sprayed and thoroughly mixed. The apparently dry powder is fed to an extruder in which it is heated to 200° C. The fluid mass is delivered from the extruder to a spinneret having twelve holes 0.006 inch × 0.006 inch (0.15 × 0.15 mm.) in length X diameter, and being controlled at a temperature of 189° C. The temperature of the melt behind the spinneret is 185° C. Extrusion pressure is 975 psig. (68 kg./cm.$^2$). White filaments are produced, having only an occasional large bubble.

EXAMPLE 2

A copolymer acrylonitrile/methyl acrylate/sodium styrenesulfonate (93.63/6/0.37 weight ratio) having an inherent viscosity of 0.9 is finely ground. Twenty-two parts of water is sprayed onto 100 parts of the copolymer in an open tray. The mixture is placed in a jar, sealed, and rolled for twelve hours. The apparently dry powder is transferred to a cylinder equipped with one 50-mesh (~20 wires/cm.) and two 200-mesh (~79 wires/cm.) screens and a spinneret with a single hole 0.01 inch long and 0.01 inch in diameter (0.25 × 0.25 mm.). A closely fitting Teflon®-gasketed, free piston is inserted. The spinneret is then closed by pressing a Teflon® pad against its outer face. The cylinder is then cooled to −10° C. and evacuated via a valved side-port between the piston and the spinneret until the water vapor pressure at that temperature is reached. The side-port valve is closed and the cylinder is then heated to 180° C. and the spinneret to about 160° C. for five minutes. A pressure of 500–600 psig. (35–42 kg./cm.$^2$) of nitrogen is applied to the piston, the pad is removed from the spinneret and a continuous filament is wound up at a rate of 45 ypm. (41 m./min.).

The apparatus and procedure of this example have been found to have utility as scouting tools, and results are obtained much more rapidly therewith. it has been found, however, that the optimum compositions and operating conditions for continuous shaping are best determined with the continuous-shaping apparatus, relying on the apparatus of this example only as a means to obtain preliminary indications of operability.

EXAMPLE 3

Several polymer/water mixtures are extruded using conditions as described in Table 2. Apparatus and procedure employed are those used in Example 2, except as specified in Table 2. Included in the series are comparison runs where the amount of water present is either too high or too low. Results of the runs are given in the last column of the Table.

TABLE 2

| Example | Polymer (Weight Ratio) | ηinh | DTA Data ΔH (max) | %$H_2O$ In Melt Based On Polymer | Spinneret Hole - mm. (Length/Dia.) | Temp. ° C. Melt/ Spinneret | Pressure On Melt psig kg/cm$^2$ | Performance Of Spin |
|---|---|---|---|---|---|---|---|---|
| 3-A-1 | AN/MA/SSS (87.6/12/0.4) | 1.28 | 5 | 19 | 0.25/0.25 | 180/185 | 600–700 (42–49) | Continuous filaments wound at 59 m./min. |
| 3-A-2 | AN/MA/SSS (87.6/12/0.4) | 1.28 | 5 | 13.6 | " | 170–175 /155 | 700(49) | Continuous filaments wound at 14 m./min. |
| 3-A-3 | AN/MA/SSS (87.6/12/0.4) | 1.28 | 5 | 11.7 | " | 175–180 /175 | 1500(105) | Poor; no fiber is produced. The water content is too low |
| 3-B-1 | PAN (100) | 1.84 | 17.1 | 33.3 | " | 210/ 185–190 | 800–1000 (56–70) | Poor; wound at 18 m./min. Some bubbles are present. These can be reduced by spinning into a 30–45 psig. atmosphere |
| 3-B-2 | PAN (100) | 1.85 | 17.1 | 27.5 | 0.38/0.38 (no screens) | 205/205 | 1200(84) | Poor; incomplete extrusion. Water content too low for a polymer of this inherent viscosity |
| 3-B-3 | PAN (100) | 1.06 | 17.1 | 27.3 | 0.25/0.25 | 205/200 | 400(28) | Wound at 9 m./min. The filament has only an occasional bubble. |
| 3-C | AN/SSS (96/4) | 1.5 | 13.5 | 30 | 0.25/0.25 | 205/185 | 800(56) | Wound at 50 m./min. |
| 3-D | AN/SSS (96/4) | 1.5 | 13.5 | 33.3 | 0.25/0.25 | 205/175 | 600–700 (42–49) | Wound at 26 m./min. The melt is quenched by the low spinneret temp. |
| 3-E | AN/SSS (98/2) | 1.25 | 14.7 | 29.0 | 0.25/0.25 | 205–210/ 175–185 | 800–1000 (56–70) | Wound at 18 m./min. |
| 3-F | AN/S (89.11) | 1.00 | 5.0 | 21.9 | 0.25/0.25 | 205/170 | 800–1000 (56–70) | Wound at 5 m./min. |
| 3-G | AN/E (96/4) | 1.61 | 11.1 | 24.3 | 0.25/0.25 | 195/185 | 1000(70) | Wound at 5–6 m./min. |
| 3-H | AN/MVP (93.3/6.7) | 1.3 | 9.1 | 24.3 | 0.25/0.25 | 205/170–175 | 800–1000 (56–70) | Wound at 27 m./min. |
| 3-I | AN/MA/MVP (88.8/5.8/5.4) | 1.32 | 6.4 | 20.4 | 0.25/0.25 | 185/175 | 1000(70) | Wound at 5 m./min. |
| 3-J-1 | AN/MA/SSS (93.6/6/.37) | 0.9 | 11.7 | 22 | 0.25/0.25 | 180/157–164 | 500–600 (35–42) | Continuous filament - wound up at 41 m./min. |
| 3-J-2 | AN/MA/SSS (93.6/6/.37) | 0.9 | 11.7 | 33.3 | 0.25/0.25 | 180/148–160 | 300–600 (21–42) | Poor; bubbly filaments - too much |

TABLE 2-continued

| Example | Polymer (Weight Ratio) | ηinh | DTA Data ΔH (max) | %$H_2O$ In Melt Based On Polymer | Spinneret Hole - mm. (Length/Dia.) | Temp. ° C. Melt/ Spinneret | Pressure On Melt psig kg/cm² | Performance Of Spin |
|---|---|---|---|---|---|---|---|---|
| | | | | | | | | water for temperature |
| 3-J-3 | AN/MA/SSS (93.6/6/.37) | 0.9 | 11.7 | 17.6 | 0.25/0.25 | 180/170–180 | 1000(70) | Poor; no extrusion - too little water |
| 3-J-4 | AN/MA/SSS (93.6/6/.37) | 0.9 | 11.7 | 28.2 (5% excess)* | 0.25/0.25 | 180/155–170 | 300–600 (21–42) | Continuous filament is smoothly wound. A 5% excess of water is tolerable |
| 3-J-5 | AN/MA/SSS (93.6/6/.37) | 1.22 | 11.7 | 33.9 (11% excess)* | 0.25/0.25 | 180/170 | 800(56) | Poor; foamy filament with flashing of water pockets (an 11% excess of water is too much) |
| 3-K-1 | AN/VA (80/20) | 1.42 | — | 28 | 0.25/0.25 | 160/160 | 1000(70) | Poor; foamy filament wound at 46 m./min. At this temperature the viscosity is too low |
| 3-K-2 | AN/VA (80/20) | 1.42 | — | 28 | 0.25/0.25 | 150/150 | 500 (35) | Filaments substantially free of bubbles. The 10° temperature reduction over that of Ex. 3-K-1 gives good results |
| 3-K-3 | AN/VA (80/20) | 1.42 | — | 12.3 | 0.38/0.38 (no screens) | 140/140 | 1400 (98) | A nearly transparent continuous filament spun very slowly for this ηinh. Water content is near minimum |
| 3-K-4 | AN/VA (80/20) | 1.42 | — | None | 0.25/0.25 (no screens) | 175/175 | 10,000(700) (a hydraulically driven piston cylinder apparatus is used) | A transparent continuous filament but it extrudes at a very low, impractical rate |
| 3-L-1 | AN/MA (60/40) | 1.11 | — | 20.4 | 0.25/0.25 | 165/150 | 400(28) | Continuous filament wound up at 41 m./min. |
| 3-L-2 | AN/MA (60/40) | 1.11 | — | None | 0.25/0.25 | 165–200/ 165–195 | 800–1200 (56 – 84) | Poor; a filament of very poor quality and of variable denier is produced. Attempts to wind the filament up are unsuccessful. |
| 3-L-3 | AN/MA (50/50) | 2.39 (intrinsic viscosity) | | 8.5 | 0.25/0.25 | 165/175 | 700(49) | Continuous opaque filament wound up at 1.8 m./min. |

AN = acrylonitrile
MA = methyl acrylate
SSS = sodium styrenesulfonate
PAN = polyacrylonitrile
VA = vinyl acetate
S = styrene
E = ethylene
MVP = 2-methyl-5-vinyl pyridine
*Over that combined as hydrate at the temperature used

EXAMPLE 4

(a) A 1.0 ηinh copolymer of 93.95% acrylonitrile, 6% vinyl acetate and 0.05% sodium styrenesulfonate is mixed as in Example 2 with water in the ratio 100/22.7; the mix is metered to a 5-zone Werner and Pfleiderer twin-screw extruder which performs the sequential functions of feeding, melting and mixing, the highest temperature therein being 180° C., thence to a pump which meters the resulting melt at 550 psig. (38.5 kg./cm.²) to a 39-hole 0.007 inch × 0.007 inch (0.18 × 0.18 mm.) spinneret having a temperature of 172° C. and the resulting white yarn is wound up at 45 ypm. (41 m./min.). It is drawn to 460% of its spun length in saturated steam at 120° C. (28 psig. - 1.96 kg./cm.²) and boiled off to yield a product having straight filament Tenacity/Elongation/Modulus/Work-to-Break values of 3.0/19/74/0.33 (gpd/%/gpd/gm.-cm.-$cm^{-1}$-$den^{-1}$). The filament has a denier of 17.

(b) Borderline processibility is attained with less water, using the apparatus of Example 4(a). To 100 parts of a copolymer acrylonitrile/methyl acrylate/sodium styrene-sulfonate (93.63/6/0.37 %) is added 18.8 parts of water and the well-mixed powder fed to the twin-screw extruder of Example 4(a). The maximum temperature in the screw is 171° C. and the 17-hole spinneret (0.25 × 0.18 mm. capillary) is also maintained at 171° C. Under a pressure of 1200 psig. (84 kg./cm.²) a yarn is produced at a maximum rate of 50 ypm.(46 m./min.).

(c) When the polymer of Example 4(a) is used with 28.2 parts of water (a 5% excess on polymer) in the apparatus of Example 2 at temperatures of about 180° C. in the cylinder and 155°–170° C. in the spinneret and a pressure of about 300–600 psig., a white continuous filament is obtained.

EXAMPLE 5

Four sealed-tube experiments are conducted to establish the proper temperature for spinning of a copolymer of 96% acrylonitrile and 4% sodium styrenesulfonate of 1.1 intrinsic viscosity.

Three tubes are charged as follows:

| | Parts water/ 100 polymer |
|---|---|
| 1. 25 parts polymer, 6.8 parts water | 27 |
| 2. 30 parts polymer, 11.1 parts water | 37 |
| 3. 25 parts polymer, 11.3 parts water | 45 |

A fourth tube is charged with 25 parts of a copolymer of acrylonitrile/methyl acrylate/sodium styrenesulfonate (93.63/6/0.37 ratio) and 8 parts water (32 parts water per 100 parts polymer). This tube is included as a calibration of the temperature of the tube contents.

The tubes are mounted on a device which turns them end over end, at approximately 2 revolutions per minute, while the air surrounding the tubes is heated at a rate of about 5° C./minute.

The apparently dry contents of all tubes slide freely from end to end until the temperature of the air reaches approximately 176° C., at which time the contents of the fourth tube become adherent and over a few degrees change from an opaque white powder to a pale, opalescent melt. From other experiments with this polymer, it is known that there is a heat transfer lag of about 20° C. in this apparatus. The contents of tubes 1, 2, and 3 begin to melt at an air temperature of approximately 195° C., that of tube number 3 apparently melting first but not enough ahead of tubes 1 and 2 to enable notation of a temperature difference. No separate phase of water is clearly detectable as such. It is concluded that the initial hydration temperature of the copolymer of tubes 1–3 is approximately 175° C.

One hundred parts of the AN/SSS copolymer is blended with 39.6 parts water and placed in the apparatus of Example 2. This represents about a 7% excess of water over the maximum normally tolerated, i.e., that required to hydrate all the nitrile groups in the polymer.

The cylinder and contents are heated to 180° C., a pressure of about 400–500 psig. (35 kg./cm.$^2$) is applied to the contents through the piston and a continuous filament is extruded and wound up at 20 yd./min. (18 m./min.). It is believed that the excessive amount of water is tolerated in this experiment because the polymer comprises units of a hydrophilic comonomer.

EXAMPLE 6

A copolymer of acrylonitrile/methyl acrylate/-sodium styrenesulfonate (93.63/6/0.37 ratio) is mixed with water in the ratio of 100/25 and processed through an extruder to prepare a hydrated composition which is fed at 186°–190° C. into a cylinder against the pressure of a piston loaded at approximately 1230 psig. (~ 86 kg./cm.$^2$). While loading, the cylinder is maintained at approximately 180° C. After 24 minutes at this pressure and temperature, the pressure is increased to 1250–1300 psig. (87.5 to 91 kg./cm.$^2$) and a valve at the outlet is opened to permit flow of the melt to the annulus of a die maintained at 184° C. while steam is simultaneously fed to the center of the outlet. The tubular film which emerges from the die is withdrawn and pinched to entrap the steam fed to the interior, the pressure of which controls the amount of lateral expansion, or blowing, of the film. There is no evidence of degradation, and only an occasional bubble is noted. Properties of the film are given in the following table:

| | |
|---|---|
| Thickness, mils (mm.) | 1.2 (0.03) |
| Tensile Strength, MD/XD psi (kg./cm.$^2$) | 6400/6000 (448/420) |
| Elongation (MD/XD, %) | 3.1/3.6 |
| Bursting Strength, 1 mil (.025 mm.) thickness, Mullen points | 5.3 |
| Tear Strength (Elmendorf) (MD/XD, gms.) | 5.3/4.0 |
| Tongue Tear Strength, MD/XD #/oz./yd.$^2$ (kg./g./m$^2$) | 0.046/0.034 ($6.15 \times 10^{-4}$/ $4.55 \times 10^{-4}$) |
| Modulus, MD/XD #/in./oz./yd.$^2$ (kg./cm./g./m.$^2$) | 454/353 (2.39/1.86) |
| WTB, MD/XD in.–#/in.$^2$/oz./yd.$^2$ (cm.–kg./cm.$^2$/g./m.$^2$) | 0.22/0.19 ($1.16 \times 10^{-3}$/ $1.00 \times 10^{-3}$) |
| T.A.P.P.I. Opacity (%) | 9.2 |
| Basis Weight oz./yd.$^2$ (g./m.$^2$) | 0.63 (21.36) |
| Density of film | 1.180 g./cc. |
| Density of outer surfaces by scraping | 1.196 and 1.198 g./cc. |

A sample of the film is cut in cross section and treated by the Cross-Section Dyeing Test described under "Test Procedures." A relatively narrow core is found to dye more deeply than the skin on each side of the film. The skin on the outside of the blown film tube is somewhat thicker than the skin on the inside.

Portions of the film are chilled in liquid nitrogen, fractured, and examined in the scanning electron microscope as described in Example 7. The voids in the core area of the film are seen to be somewhat flattened in the plane of the film. In a plane perpendicular to the machine direction, there are about $7.5 \times 10^5$ voids per mm.$^2$. In a plane perpendicular to the transverse direction there are between 11 and $26 \times 10^5$ voids per mm.$^2$.

Fragments of the surface of the film are prepared by methods analogous to those described under the test procedure "Density of Surface Fragments." The average density of whole film pieces is 1.180 g./cc. Fragments scraped from the surface on the inside of the film tube average 0.016 g./cc. higher in density than the whole film, and fragments from the outside surface average 0.018 g./cc. higher.

EXAMPLE 7

A copolymer of acrylonitrile/vinyl acetate/sodium styrenesulfonate in a 93.95/6/0.05 ratio with an inherent viscosity ($\eta$ inh) of 1.0 is finely ground. Onto 100 parts of this polymer in an open tray, 20.9 parts of water is sprayed. The mixture is placed in a jar, sealed and rolled for twelve hours. The apparently dry powder is transferred to a cylinder equipped with one 50-mesh (~88 20 wires/cm.) and two 200-mesh (~79 wires/cm.) screens and a spinneret with a single hole 0.01 inch long and 0.01 inch in diameter (0.25 × 0.25 mm.). A closely fitting, Teflon®-gasketed, free piston is inserted. The spinneret is then closed by pressing a Teflon® pad against its outer face. The cylinder is then cooled to −10° C. and evacuated via a valved side-port between the piston and the spinneret until the water vapor pressure at the temperature is reached. The side-port valve is closed and the cylinder heated to 180° C., and the spinneret is heated to about 165° C. for 5 minutes. A pressure of 800–900 psig. (56–63 kg./cm.$^2$) of nitrogen is applied to the piston, the Teflon®pad removed, and a continuous, white filament is wound up at the rate of 45 ypm. (41 m./min.).

Portions of the filament are cooled in liquid nitrogen, and are bent sharply so that they fracture approximately perpendicular to the axis of the filament. The filament ends are prepared and photographed by scanning electron micrography, following standard procedures. A sheath-core configuration exists. At a magnification of about 2500X, the core area of each end examined shows multitudinous characteristic circular microvoids. One cross section shows an average of $2.0 \times 10^5$ voids per mm.$^2$ of core area, the largest void having a diameter of about 0.38$\mu$. Another cross section shows an average of $4.4 \times 10^5$ voids per mm.$^2$ of core, the largest void having a diameter of about 0.29$\mu$. A third cross section shows an average of $3.4 \times 10^5$ voids per mm.$^2$ of core area, the largest void having a diameter of about 0.38 micron. The majority of the voids are much smaller in diameter. Some with diameters of down to about 0.12$\mu$ or even less are visible at 13,000X magnification.

There are substantially no voids larger than about 0.05 micron in the sheath, i.e., substantially no optical voids in the sheath.

EXAMPLE 8

One hundred parts of a 1.0 [$\eta$] copolymer of acrylonitrile/methyl acrylate/sodium styrenesulfonate (93.63/6/0.37 ratio) is mixed with 25 parts water as described in Example 2. The mix is metered to a twin-screw extruder like that employed in Example 4, the highest temperature is 177° C. and the molten mass is metered at 700 psig. (49 kg./cm.$^2$) to a spinneret having 39 holes of 0.010 inch × 0.007 inch (0.25 mm. × 0.18 mm.) in length × diameter which is maintained at 175° C. The filaments issuing from the spinneret are passed through a spinning chamber containing a mixture of air and water vapor at a pressure of 20 psig. (1.4 kg./cm.$^2$) and a temperature of 64° C. The yarn is collected on a bobbin at about 75 ypm. (68 m./min.). The yarn is then unwound and passed through a tube containing saturated steam at a pressure of about 20 psig. (1.4 kg./cm.$^2$), where it is drawn to approximately 600% of its as-spun length and wound up at about 150 ypm. (137 m./min.). The boiled-off yarn has filament Tenacity/Elongation/Modulus of 3.0/20/68 (gms. per denier/%/gms. per denier). The filament has a denier of 11.8. Microscopic examination of one filament cross section shows a sheath on the filament of a thickness amounting to 28% of the filament radius; the remaining structure comprises a core which contains multitudinous voids. The average density of the filament is 1.083 g./cc. Microscopic examination of the filament surface shows deep longitudinal striations. The resulting structure shows a water absorption rate of 0.095 cc./sec. as determined by a modification of the method of E. H. Buras, Jr., et al., "Measurement and Theory of Absorbency of Cotton Fabrics," Tex. Res. Journal, Vol. 20, April, 1950, pp. 239–240, the modification being to use as sample a yarn wrapped on a form rather than the wadding or fabric of Buras et al. The wicking rate of a commercial dry-spun acrylic fiber in the same range of denier is about 0.06 cc./sec. in this test.

A sample of the drawn filament of this Example is treated by the Cross-Section Dyeing test described under "Test Procedures." The filaments are placed in the dye bath for 40 seconds at a temperature of 180° F. (82° C.). The core of the filament is sharply differentiated from the sheath by being dyed to a distinctly darker color.

A sample of the drawn filaments is mounted in epoxy resin and 0.2$\mu$ sections are cut with a diamond knife microtome. Pictures taken in the electron microscope at 16,1200X magnification show that the core voids have been partially closed in one direction by the action of the diamond knife, but the diameters parallel to the knife edge measure about 0.2$\mu$.

A montage of scanning electron micrograph pictures of the drawn filament is made as described under Striation Length test procedure. The maximum striation length is 258$\mu$, the minimum length is 39$\mu$, and the average striation length is 80$\mu$. The average striation counts is 13.1 for the central half-width of the filament image. The average striation depth determined from an optical photomicrograph prepared as described under the test procedures, is 1.29$\mu$, or 6.1% of the filament radius.

Using the procedure set forth in the Differential Solubility Rate test, the drawn filaments separate from the resin matrix. Dissolution occurs preferentially in the core such that the filament sheaths persist for a time after the cores disappear. By contrast, fibers dry spun from solution in dimethylformamide by conventional methods known in the art using the same polymer, when treated in identical fashion with dimethylformamide, do not show relative to the core, a more solvent-resistant filament sheath. Rather, a substantial amount of specimen erosion is observed due to channeling inward of solvent from the periphery.

There are substantially no voids larger than about 0.05 micron in the sheath, i.e., substantially no optical voids in the sheath.

EXAMPLE 9

A copolymer of 90% acrylonitrile and 10% vinyl acetate, having an intrinsic viscosity of 1.25 is mixed with water in the ratio 100/25. The mix is metered to the twin-screw extruder of Example 8, the highest temperature therein being 177° C. The resulting melt is metered at 1200 psig. (84 kg./cm.$^2$) to a 39-hole 0.14 inch × 0.007 inch (0.36 mm. × 0.18 mm.) spinneret having a temperature of 177° C. The yarn obtained is wound up at 33 ypm. (30 m./min.). Cross sections of the filament prepared in a Hardy plate or by other conventional methods are examined under a microscope. A uniform sheath surrounding a voided ocre is distinctly visible.

A sample of the filament of this example is treated by the Cross-Section Dyeing Test described under "Test Procedures." When examined under a microscope the filament cross sections are seen to have dyed very distinctly darker in the core area than in the sheath. The sheath is practically free of color.

The sheath density is measured as described in the test procedure entitled "Density of Surface Fragments" and is found to be 0.048 gm./cc. higher than the overall filament density of 1.140.

There are substantially no voids larger than about 0.05 micron in the sheath, i.e., substantially no optical voids in the sheath.

EXAMPLE 10

(a) A yarn is prepared as in Example 8 except that the air/water vapor chamber is maintained at 140° C. After being drawn to 600% of its as-spun length, the yarn has a filament denier of 9.88.

Sections of the drawn filaments are prepared and treated with dimethylformamide under the microscope as described by the Differential Solubility test. The cores of the filaments dissolve first, leaving the sheath sections which persist for an appreciable time before dissolving. For filaments prepared similarly to those in the above paragraph, preferential solvent action on the core is further observed by the formation of depressions at the ends of the filament when intact filament lengths with square-cut ends are placed on a microscope slide under a cover glass and treated with a solvent such as dimethylformamide, zinc chloride/water (65/35), or diemthylsulfoxide/tert.-butanol (80/20).

A montage of scanning electron micrograph pictures of the 6X drawn filament is made as described under the Striation Length test procedure. The maximum striation length observed is 199μ, the minimum is 32μ, and the average striation length is 72μ. The average striation count is 13.5 for the central half width of the filament image. The striation depth determined from an optical photomicrograph as described under Test Procedures, is 1.15μ or 5.1% of the radius of the filament.

A sample of the 6X drawn filament is boiled off and the filaments are mounted in epoxy resin parallel to the surface. The composite mount is polished down by standard metallographic techniques from 600 grit paper through Linde B polishing compound, so that at least one filament is half ground away, leaving a longitudinal section of the middle of the filament. This is lightly etched for 25 seconds in dimethylformamide at room temperature, and then immediately rinsed in water and dried. The etched section is metallized with gold palladium alloy, and a montage of scanning electron micrographs is prepared as described under Striation Length. The longitudinal voids in the core are represented by long dark lines, whose length is measured and converted to absolute length by reference to the degree of magnification used. The longest void length measures 281μ, the shortest is 12μ long, and the average of 21 voids measured at random is 177μ.

(b) A sample of the yarn drawn 6X is boiled off in water for ½ hours, and is immediately annealed in an oven at 190° C. for 4 or 5 minutes. Annealing is carried out to remove optical voids, so that their presence will not affect the apparent depth of color of the core area of the filament cross section. The annealed yarn is subjected to the Cross-Section Dyeing test described under "Test Procedures." When examined under a microscope, the dyed cross sections show a very distinct difference in shade between the sheath and the core, with the sheath showing relatively little color.

(c) A sample of yarn is prepared exactly as described above except that the yarn is drawn only 4X in 19 psig. (1.34 kg./cm.$^2$) steam. It is subjected to analysis by "Solvent Stripping Method B" and "Density Determination Method B" as described under Test Procedures and the data plotted as described under "Density of Residual Portion" and "Density of Portion Removed." The data tabulated below are read from the smooth curve which best fits the experimentally determined points.

| Wt. % of Residue | Density of Residue (gms./cc.) | Density of Portion Removed (gms./cc.) |
|---|---|---|
| 95 | 1.1204 | |
| 90 | 1.1164 | 1.198 |
| 85 | 1.1142 | 1.157 |
| 80 | 1.1126 | 1.141 |
| 75 | 1.1114 | 1.131 |
| 70 | 1.1106 | 1.122 |
| 65 | 1.1101 | 1.117 |

-continued

| Wt. % of Residue | Density of Residue (gms./cc.) | Density of Portion Removed (gms./cc.) |
|---|---|---|
| 60 | 1.1097 | 1.115 |

The surface striations of the annealed 4X-drawn yarn are examined by the methods described under Test Procedures. The maximum striation length for a filament of the yarn is 148μ, the minimum length is 43μ, and the average striation length is 75μ. The average striation count is 13.4 for the central half width of the filament image. The striation depth is 1.25μ.

(d) A sample of the 4X drawn yarn is prepared with the variation that the filament is drawn between positively-driven rolls immediately after spinning and before being wound up. The drawn filament is boiled off ½ hour and annealed wet in an oven at 190° C. for 4–5 minutes to remove all optical voids in the core. The filament has a density of 1.158 g./cc. Particles of surface scraped from the annealed filament as described under the Density of Surface Fragments test have a density of 1.187 g./cc., which is 0.029 g./cc. higher than the averge density of the whole filament.

In no filaments of this Example 10 were any substantial number of voids larger than about 0.05 micron seen in the sheath.

EXAMPLE 11

One hundred parts of the copolymer of Example 1 is mixed as described in that example with 26.6 parts of water. The mixture is extruder-spun as in Example 8 except that the highest temperature is 175° C. and the molten mass is metered at 600 psig. (42 kg./cm.$^2$) to a spinneret having 38 holes of 0.010 inch × 0.007 inch (0.25 × 0.18 mm.) in length × diameter which is maintained at 172° C. The filaments issuing from the spinneret are immediately passed through a chamber 8 inches (20.3 cm.) long in which they are subjected to air at 140° C. – 145° C. under atmospheric pressure and are then wound up at 75 ypm. (68 m./min.). The yarn has a filament denier of 70.

Short lengths of the as-spun filament are prepared and treated with dimethylformamide under the microscopic as described in the Differential Solubility test. The cores of the filament sections are seen to dissolve rapidly, leaving only the sheath sections at the ends.

The density of the intact filament is found to be 1.051 g./cc. Surface fragments obtained by filament scraping show a density of 1.195 g./cc. which is greater than the average filament density by 0.144 g./cc.

A sample of the as-spun filament is subjected to X-ray analysis for orientation angle by standard methods. A similar analysis is made of the same filament after about 3–5μ of the radius has been etched away by exposure to dimethylformamide at about 50° C. for 10 minutes followed by rinsing in water and drying. The orientation angle of the whole filament is 100°, and that of the etched filament is 145°, showing that a surface layer more oriented than the residual core has been removed. The etched filament, when drawn 6X in boiling water failed to develop the striations shown by drawn samples of the as-spun filament.

Taper sections of the undrawn filament are subjected to analysis for skin orientation angle by electron diffraction. This is done by mounting in epoxy resin a section of filament bent into the shape of a horseshoe about 6 mm. wide. The mounted filament is then microtomed at the bend in a plane perpendicular to the arms of the horseshoe. Taper sections of the filament about 0.1 to 0.2μ thick are prepared and mounted on a transmission electron microscope grid by standard procedures. A selected-area electron diffraction pattern is obtained from the tip of the taper section corresponding to the skin of the original filament. From this, the polymer orientation angle is determined as is done for X-ray diffraction data in standard procedures. The skin is found to have an orientation angle of 66°. The orientation angle for the whole filament is found by X-ray analysis to be 100°, as mentioned above. This again indicates the existence of a surface layer more highly oriented in the filament direction than the whole filament.

There are substantially no voids larger than about 0.05 micron in the sheath, i.e., substantially no optical voids in the sheath.

EXAMPLE 12

Apparatus such as described in Example 8 is used to prepare a 90 dpf (as spun) yarn from a melt comprising 100 parts 1.0 intrinsic viscosity polymer having the composition of that employed in that example and 25 parts water. The conditions are as follows: highest extruder temperature: 175° C.; pressure: 1050 psig (74 kg./cm.$^2$); spinneret: 38 holes 0.36 × 0.18 mm. (length × diameter); spinneret temperature: 177° C.; spinning chamber: 46 cm. long, 26 psig (1.8 kg./cm.$^2$) pressure, 66° C. temperature in a mixture of air and water vapor and windup: 89 meters/min.

The yarn is drawn to 800% of its as-spun length in an atmosphere of saturated steam at 20 psig. (1.4 kg./cm.$^2$). After boil-off in water, the yarn has a straight tenacity/elongation/initial modulus of 4.0 gpd/25%/66 gpd and corresponding loop properties of 0.86/2.1 and 58. It is found to have a Luster Source Ratio (LR) of 2.43. At a magnification of 25,500X in a transmission electron microscope, a cross-section reveals 140 × $10^5$ voids/mm.$^2$ in the core, typical voids being .07 to 0.08 micron in diameter, the largest being about 0.31 micron and the smallest about 0.04 micron in the overall cross-section. This filament has a sheath of about 4μ thickness.

By examination as described for striation length, count and depth, the following figures were determined by the following drawn filaments prepared as in this example:

| Times Drawn | Striation Depth (microns) | Striation Length (microns) | Striation Count |
|---|---|---|---|
| 2× | .60 | 57 | 15 |
| 4× | .90 | 24 | 13 |
| 8× | .79 | 78 | 11 |

Samples of the as-spun (undrawn) yarn of this example and that drawn to 800% of its as-spun length are subjected to analysis for density gradient by "Solvent Stripping Method A" and Density-Determination Method A as described under Test Procedures. Results are tabulated below.

| % Residue After Solvent Stripping | Avg. Density of Residue (no. samples) Undrawn | 8X-Drawn |
|---|---|---|
| 100 (unstripped) | 1.0548 (8) | 1.0739 (5) |
| 98 | 1.0543 (4) | |
| 97.6 | 1.0471 (2) | |

-continued

| % Residue After Solvent Stripping | Avg. Density of Residue (no. samples) Undrawn | 8X-Drawn |
|---|---|---|
| 96.9 | 1.0543 (2) | |
| 96.6 | | 1.0701 (2) |
| 96.4 | 1.0488 (2) | |
| 95.3 | | 1.0696 (1) |
| 94.9 | 1.0466 (2) | |
| 94.3 | 1.0506 (2) | |
| 93.8 | | 1.0678 (2) |
| 91.1 | 1.0434 (2) | |
| 90.1 | 1.0413 (2) | 1.0635 (2) |
| 90.0 | 1.0413 (2) | |
| 88.8 | 1.0411 (2) | |
| 87.7 | 1.0360 (1) | |
| 87.3 | | 1.0569 (2) |

As a comparison, the same test methods are used to evaluate commercially available acrylic fibers; one is an imported, dry-spun, semi-dull continuous filament of 1.5 dpf, and the other a domestic acrylic wet-spun, bright carpet staple of 15 dpf. Density by Stepwise Removal of Surface Layers is tabulated below for the two commercial products:

| % Residue After Solvent Stripping of Layers | Average Density of Residue (no. samples) 1.5 dpf Continuous Filament | 15 dpf Staple |
|---|---|---|
| 100 | 1.1480 (7) | 1.1832 (8) |
| 99.3 | 1.1521 (2) | |
| 99.1 | 1.1434 (1) | |
| 98.4 | 1.1453 (2) | |
| 98.2 | 1.1458 (2) | |
| 96.5 | 1.1500 (1) | |
| 96.8 | 1.1426 (2) | |
| 95.0 | 1.1529 (2) | |
| 90.4 | 1.1480 (1) | |
| 87.7 | 1.1592 (1) | |
| 77 | | 1.1951 |
| 76.7 | | 1.1921 |
| 73.5 | | 1.1874 |
| 71.9 | | 1.1836 |
| 65.5 | | 1.1967 |
| 54.2 | | 1.1880 |
| 52.9 | | 1.1868 |

There are substantially no voids larger than about 0.05 micron in the sheath, i.e., substantially no optical voids in the sheath.

EXAMPLE 13

A. The copolymer of Example 1 is mixed, as in that example, with water and ethylene carbonate in the ratio of 100/25.8/3.23. The mix is metered to a twin-screw extruder comprising, in sequence, feed, melting, mixing and metering zones, the highest temperature therein being 172° C. The resulting melt is metered at 600 psig. (42 kg./cm.$^2$) to a spinneret having 38 holes 0.010 inch × 0.007 inch in length × diameter (0.25 × 0.18 mm.) which is maintained at 175° C. A continuous yarn is spun and wound up at 105 ypm. (96 m./min.) after passage through a conditioning chamber 6 inches (~15-cm.) long to which is fed room-temperature air to maintain a presence of 20 psig. (1.4 kg./cm.$^2$) resulting in a temperature of 140° C. The yarn is drawn in saturated steam (120° C. - 20 psig. - 1.4 kg./cm.$^2$) to three draw ratios, 6X, 8X, 11.5X (i.e., to 600%, 800%, and 1150% of its as-spun length, respectively). The tensile properties, as measured on single boiled off filaments of the drawn yarns, are tabulated below:

| Draw Ratio | Denier | Straight Tenacity/ Elongation/Modulus (gpd./%/gpd.) | Loop Tenacity/ Elongation (gpd./%) |
|---|---|---|---|
| 6× | 9.9 | 3.96/28.4/67 | 0.8/2.0 |
| 8× | 7.6 | 4.28/24.1/64 | 1.50/9.0 |
| 11.5× | 5.5 | 4.99/21.9/65 | 1.30/6.9 |

B. In a comparative preparation, the copolymer of Example 1 is mixed with water as in that example in the ratio of 100/26.5. It is processed exactly as is the composition of Part A of this example with the following exceptions; the spinneret temperature is 172° C.; the conditioning chamber is 8 inches (20 cm.) long; the temperature in the conditioning chamber is in the range of 140°–145° C.; windup is 75 ypm (68 m./min.); and steam pressure is 35 psig (2.5 kg./cm.$^2$) in drawing. The 70 dpf yarn is wound up at 75 ypm. After drawing to 6X, 8X and 12X (i.e., to 600%, 800% and 1200% of its as-spun length, respectively) and boiling off, the tensile properties are found to be as follows:

| Draw Ratio | Denier | Straight Tenacity/ Elongation/Modulus (gpd./%/gpd.) | Loop Tenacity/ Elongation/Modulus (gpd./%) |
|---|---|---|---|
| 6 | 17 | 3.67/26/67.6 | 0.67/1.6 |
| 8 | 11.9 | 4.56/22.8/67.0 | 0.83/2.1 |
| 12 | 8.2 | 5.24/10.6/70.3 | 0.81/1.7 |

Any compatible solvent for the polymer is satisfactory as a substitute for ethylene carbonate in this process; by "compatible" is meant that (1) it must be capable of forming a diluable solution thereof containing about 10% by weight at some temperature below about 180° C.; (2) the resulting solution must have a homogeneous appearance to the unaided eye; and (3) no component of the solvent may undergo substantial chemical reaction with other components of the solvent, the polymer, the polymer hydrate or free water at a temperature of 180° C. for a period of at least 1, preferably 30, minutes. It is satisfactory for a solvent to meet these criteria only under conditions of augmented pressure.

EXAMPLE 14

This example illustrates the unique Luster Source Ratio (LR) of filaments of this invention relative to that of prior art acrylonitrile-polymer filaments.

Filaments equivalent to those of several preceding examples are prepared for LR analysis. These are identified as follows:

A. As Example 1 product; as-spun filament.

B. Example 14A product, but after drawing to 700% of its as-spun length to result in a 3 dpf yarn.

C. As Example 12 product, but drawn to 600% of its as-spun length (vs. to 800%).

D. As Example 14C product, but drawn to 400%.

Two samples are shaped from hydrate melts comprising a polymer solvent, as described in Example 13, and evaluated for LR. These are:

E. Yarn prepared essentially as in Example 13 to yield a 10 dpf, 39 filament yarn which is crimptextured and tufted into a 32-oz. face-fiber carpet and dyed to a medium blue shade with commercial basic dyes. Filaments are removed for LR evaluation.

F. Filaments such as those of Example 14E but removed from a carpet after extensive wear testing and cleaning.

Several prior art acrylic fibers are evaluated in the LR procedure, as follows:

G. Commercial, domestic, dry-spun, semi-dull staple of about 3 dpf.

H. Commercial, domestic, dry-spun, semi-dull staple of about 4 dpf.

I. Imported, dry-spun continuous-filament yarn of about 6 dpf.

J. Imported, dry-spun, continuous filament yarn of about 3 dpf.

K. Imported, wet-spun staple of about 19 dpf.

Results of analysis of the foregoing samples are tabulated below:

| | | Prior Art | |
|---|---|---|---|
| Sample | LR | Sample | LR |
| A | 0.95 | G | <0.11 |
| B | 2.70 | H | 0.09 |
| C | 2.46, 2.31 | I | 0.43, 0.43 |
| D | 1.61, 1.91 | J | <0.02, <0.08 |
| E | 1.25 | K | 0.15 |
| F | 1.42 | | |

EXAMPLE 15

This example serves further to illustrate utility of the composition and process of this invention in the production of the novel filaments from several acrylonitrile polymers.

The compositions employed in all parts of this example are: polymer 100 parts; water 25 parts; 2-pyrrolidone 6.6 parts.

The apparatus employed is a twin-screw extruder such as described in Example 4 modified to permit addition of the water at a point approximately ⅓ of the distance from the feed to discharge end and to accept a continuous feed of pelletized, dry polymer. The polymer used, conditions employed and product characteristics are detailed in Table 3.

TABLE 3

| Example | 15(a)-1 | (a)-2 | (a)-3 | 15(b) | 15(c) | 15(d) | 15(e) |
|---|---|---|---|---|---|---|---|
| *Polymer Compn. | 5.5VA/0.05SSS | — | — | 13.5MA | 10.6VA | 6MA/0.37SSS | 6MA/0.37SSS |
| Extruder max. temp. (° C.) | 179 | — | — | 183 | 180 | 178 | 178 |
| Spinneret-holes | 45 | — | — | 45 | 45 | 45 | 39 |
| -1 × d (mm.) | 0.5 × 0.15 | — | — | 0.5 × 0.15 | 0.5 × 0.15 | 0.5 × 0.15 | 0.36 × 0.18 |
| temp. (° C.) | 178 | — | — | 183 | 179 | 179 | 179 |
| Spin Press. (kg./cm.$^2$) | 95.6 | — | — | 112 | 84 | 71 | 65 |
| Spin Chamber-Length (cm.) | 45 | — | — | 45 | 45 | 45 | 45 |
| -Press. (kg./cm.$^2$) | 1.4 | — | — | 2.1 | 1.8 | 2.1 | 2.8 |
| -Temp. (° C.) | 45 | — | — | 50 | 48 | 46 | 47 |
| Windup (m./min.) | 82 | — | — | 178 | 169 | 240 | 160 |
| Yarn dpf | 70 | — | — | 24 | 22 | 24 | 52 |
| Drawing-Ratio | 4 | 6 | 7 | 6 | 7 | 8 | 5 |
| —Steam Press (kg./cm.$^2$) | 3.5 | — | — | 4.2 | | 1.6 | 2.1 |
| -Feed rate (m./min.) | — | — | — | | | 91 | 46 |
| **T/E/Mi/To (straight) (gpd/%/gpd/gpd) | 2.26/30.2/ 53.7/0.47 | 3.46/22.8/ 70.6/0.45 | 3.90/23.6/ 73.3/0.52 | 2.49/39.4/ 54.9/0.61 | 3.93/31.8 56.7/0.63 | 5.31/24.9/ 75.6/0.66 | 3.45/28.6/ 66.3/0.57 |
| **T/E/Mi/To (loop) | 0.72/2/44.4/ | 0.82/2.22/ | .77/1.49/ | 2.24/33.2/ | 2.03/19.5/ | 2.30/12.8/ | 1.51/10.1/ |

TABLE 3-continued

| Example | 15(a)-1 | (a)-2 | (a)-3 | 15(b) | 15(c) | 15(d) | 15(e) |
|---|---|---|---|---|---|---|---|
| | 0.008 | 49.1/0.12 | 57.2/0.006 | 48.1/0.47 | 50.1/0.25 | 62.8/0.19 | 55.8/0.11 |
| dpf | 18.4 | 10.4 | 9.6 | 6.24 | 3.8 | 3.2 | 10.8 |
| ***Density Gradient ($\Delta\rho$/10% wt. removed) | 0.0135 | — | — | 0.013 | 0.0036 | 0.0140 | 0.0138 |
| LR | 0.79 (draw ratio 2) | | | 1.35 | 1.36 | 1.538 | 1.173 |

*MA = methyl acrylate;
VA = vinyl acetate;
SSS = sodium styrenesulfonate (parts by wt. of comonomeric modifier)
**Determined on boiled-off filaments
***For Examples 15(a), 15(b) and 15(c) the density gradient data were obtained by Solvent-Stripping Method A and Density Determination Method B. Data for samples 15(d) an 15(e) were obtained by use of Solvent-Stripping Method A and Density-Determination Method A; data from these latter determinations are detailed further below.

| Example | Wt.-% Remaining After Solvent Stripping | Density of Residual Fil. | Calculated Density of Removed Increment |
|---|---|---|---|
| 15(d) | 100 | 1.0314 | |
| | 95 | 1.0230 | 1.2221 |
| | 90 | 1.0174 | 1.1354 |
| | 85 | 1.0142 | 1.0750 |
| | 80 | 1.0122 | 1.0473 |
| | 75 | 1.0109 | 1.0321 |
| | 70 | 1.0097 | 1.0280 |
| | 65 | 1.0085 | 1.0256 |
| 15(e) | 100 | 1.0868 | |
| | 95 | 1.0796 | 1.2446 |
| | 90 | 1.0730 | 1.2139 |
| | 85 | 1.0673 | 1.1800 |
| | 80 | 1.0630 | 1.1412 |
| | 75 | 1.0603 | 1.1053 |
| | 70 | 1.0587 | 1.0832 |
| | 65 | 1.0578 | 1.0706 |

EXAMPLE 16

A polymer such as used in Examples 15(d) and (e) is employed in this example to illustrate retention of a positive density gradient in filaments which have been annealed to eliminate the voids.

One hundred parts of polymer, 25 parts water and 6.4 parts ethylene carbonate are processed in the twin-screw extruder of and in the process of Example 8. The highest temperature in the extruder, and the temperature of the spinneret are 177° C. The melt is extruded at 850 psig. (60 kg./cm.$^2$) through a 45-hole spinneret, each hole being 0.13 mm. X 0.10 mm. in length X diameter, into a spinning chamber 12 inches (30 cm.) in length in which is maintained an atmosphere of steam and air at 20 psig. (1.4 kg./cm.$^2$) and 131° C. The extruded filaments are withdrawn from the chamber and wound up at 165 ypm. (150 m./min.). The as-spun yarn is 16 denier per filament. The yarn is drawn in 64 psig. (45 kg./cm.$^2$) steam at a feed rate of 50 ypm. (46 m./min.) and wound up at 325 ypm. (297 m./min.) (6.5 × draw).

A portion of the yarn is soaked in water at room temperature for 40 hours and led in 15 wraps each over two sets of canted rolls maintained at a temperature of 230° C. at a surface speed of 201 ypm. The filaments are found to be free of optical voids when examined in cross-section.

The yarn is analyzed for density gradient by the "Solvent-Stripping Method A" and the "Density-Determination Method A" as detailed under Test Procedures and the data relating residue density to % residue treated by the "least squares" method to determine the slope. By this means it is seen that the slope is 0.1583 at a correlation coefficient of 0.993, indicating a $\Delta\rho$/10% weight loss of 0.016 gm./cc.

There are substantially no voids larger than about 0.05 micron in the sheath, i.e., substantially no optical voids in the sheath.

Additives recognized in the art may be used to modify the filaments of this invention provided they do not alter the novel structural features of the filaments. For delustering, the most generally used additive, titania, is of particular value. Additives known in the art for development of flame retardancy, antistatic properties, and those having utility as soil-release agents, colorants such as pigments and dyes, thermal stabilizers, etc., are compatible and effectual with the compositions of this invention if stable to hydrolysis and thermal decomposition under the conditions specified.

The foregoing detailed description has been given for clearness of understanding only and no unnecessary limitations are to be understood therefrom. The invention is not limited to the exact details shown and described for obvious modifications will occur to those skilled in the art.

The embodiments of the invention in which an exclusive property or privilege is claimed are defined as follows:

1. Process for spinning fibers of an acrylonitrile polymer which comprises adding water to an acrylonitrile polymer that contains at least about 40 weight percent units of acrylonitrile, in an amount equivalent as a minimum to either 45% of that required to hydrate all the nitrile groups or 80% of that required to hydrate the coupled nitrile groups (on a 1/1 water molecule/nitrile group basis), whichever is larger, and as a maximum the amount combined as hydrate plus 7 weight percent water based on polymer, the total water not to exceed the amount necessary to hydrate all nitrile groups in the polymer and maintaining the resulting substantially single phase composition under at least autogenous pressure at a temperature ranging between about 25° C less to about 10° C more than the temperature of hydration as determined by Laser Raman Spectroscopy and then extruding the composition under pressure through an extrusion orifice to obtain acrylonitrile polymer filaments.

2. The process of claim 1 wherein the temperature range is 170°-190° C.

* * * * *